US012161145B2

(12) United States Patent
Kobal et al.

(10) Patent No.: US 12,161,145 B2
(45) **Date of Patent: *Dec. 10, 2024**

(54) INHIBITION OF SENSORY IRRITATION DURING CONSUMPTION OF NON-SMOKEABLE TOBACCO PRODUCTS

(71) Applicant: Philip Morris USA Inc., Richmond, VA (US)

(72) Inventors: Gerd Kobal, Sandy Hook, VA (US); Justin Heynekamp, Glen Allen, VA (US); Timothy B. Langston, Mechanicsville, VA (US); Peter Reeh, Erlangen (DE); Munmaya K. Mishra, Manakin Sabot, VA (US); Jason W. Flora, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 441 days.

This patent is subject to a terminal disclaimer.

(21) Appl. No.: 17/412,564

(22) Filed: Aug. 26, 2021

(65) Prior Publication Data

US 2021/0378281 A1 Dec. 9, 2021

Related U.S. Application Data

(60) Continuation of application No. 16/179,107, filed on Nov. 2, 2018, now Pat. No. 11,129,405, which is a (Continued)

(51) Int. Cl.
*A24B 13/00* (2006.01)
*A24B 15/18* (2006.01)
(Continued)

(52) U.S. Cl.
CPC ..... *A24B 13/00* (2013.01); *A24B 15/18* (2013.01); *A24B 15/282* (2013.01); *A24B 15/30* (2013.01)

(58) Field of Classification Search
CPC ..... A24B 13/00; A24B 15/18; A24B 15/282; A24B 15/30
See application file for complete search history.

(56) References Cited

U.S. PATENT DOCUMENTS 3,137,631 A 6/1964 Soloway
4,351,347 A 9/1982 Sprecker
(Continued)

FOREIGN PATENT DOCUMENTS

CN 1579258 A 2/2005
EP 1909603 A2 4/2008
(Continued)

OTHER PUBLICATIONS

L. Liu et al., "Nicoline Inhibits Voltage-Dependent Sodium Channels and Sensitizes Vanilloid Receptors," J. Neurophysiol. 91: 1482-91, The American Physiological Society (2004).
(Continued)

*Primary Examiner* — Dionne W. Mayes
(74) *Attorney, Agent, or Firm* — Harness, Dickey & Pierce, P.L.C.

(57) ABSTRACT

An orally-enjoyable tobacco product includes a portion of smokeless tobacco comprising an active ingredient and either: (1) a collection of tobacco particles at least partially enclosed by a coating comprising a water-soluble non-crosslinked component and a substantially water-insoluble cross-linked component, or (2) a pouch comprising smokeless tobacco enclosed in a water-permeable wrapper. The active ingredient is selected from the group consisting of a mercaptan, camphor, borneol, isoborneol, bornyl acetate, isobornyl acetate, mono-bornyl succinate, mono-isobornyl succinate, mono-bornyl formate, and mono-isobornyl for-
(Continued)

mate. The active ingredient is present in an amount effective to reduce or eliminate the sensory irritation arising from the smokeless tobacco.

20 Claims, 11 Drawing Sheets

Related U.S. Application Data division of application No. 14/719,510, filed on May 22, 2015, now Pat. No. 10,117,453, which is a continuation of application No. 13/290,768, filed on Nov. 7, 2011, now Pat. No. 9,038,643, which is a continuation of application No. 13/071,825, filed on Mar. 25, 2011, now abandoned.

(60) Provisional application No. 61/318,268, filed on Mar. 26, 2010.

(51) Int. Cl.
*A24B 15/28* (2006.01)
*A24B 15/30* (2006.01)

(56) References Cited

U.S. PATENT DOCUMENTS 4,378,380 A 3/1983 Scarpellino et al.
4,497,331 A * 2/1985 Nellen ..... A24B 13/00 131/370
4,959,380 A 9/1990 Wilson
5,167,244 A 12/1992 Kjerstad
5,275,859 A 1/1994 Phillips et al.
5,298,257 A 3/1994 Bannon et al.
5,456,745 A 10/1995 Roreger et al.
5,505,958 A 4/1996 Bello et al.
5,556,636 A 9/1996 Yano et al.
5,643,905 A 7/1997 Moormann
5,770,220 A 6/1998 Meconi et al.
5,891,463 A 4/1999 Bello et al.
6,019,851 A 2/2000 Pittet et al.
6,103,266 A 8/2000 Tapolsky et al.
6,150,424 A 11/2000 Breitenbach et al.
6,165,512 A 12/2000 Mezaache et al.
6,183,770 B1 2/2001 Muchin et al.
6,224,900 B1 5/2001 Hoffmann
6,264,977 B1 7/2001 Hoffmann
6,270,804 B1 8/2001 Getz et al.
6,277,401 B1 8/2001 Bello et al.
6,284,803 B1 9/2001 Kothrade et al.
RE37,934 E 12/2002 Hoffmann
6,548,510 B1 4/2003 Asmussen et al.
6,562,363 B1 5/2003 Mantelle et al.
6,582,724 B2 6/2003 Hsu et al.
6,627,234 B1 9/2003 Johnson et al.
6,638,528 B1 10/2003 Kanios
6,682,757 B1 1/2004 Wright
6,750,291 B2 6/2004 Kim et al.
6,756,052 B1 6/2004 Koch et al.
6,780,504 B2 8/2004 Rupprecht et al.
6,854,470 B1 2/2005 Pu
6,893,655 B2 5/2005 Flanigan et al.
6,893,661 B1 5/2005 Odidi et al.
6,936,268 B1 8/2005 Muta et al.
6,949,264 B1 9/2005 McGrew et al.
6,953,593 B2 10/2005 Kuhrts
7,008,628 B2 3/2006 Ron et al.
7,030,092 B1 4/2006 Levine
7,032,601 B2 4/2006 Atchley et al.
7,063,859 B1 6/2006 Kanios et al.
7,090,858 B2 8/2006 Jayaraman
7,163,705 B2 1/2007 Johnson et al.
7,186,958 B1 3/2007 Nelson
D568,576 S 5/2008 Neidle et al.
8,671,952 B2 3/2014 Winterson et al.
9,038,643 B2 5/2015 Kobal et al.
10,117,453 B2 * 11/2018 Kobal et al. ..... A24B 15/282
2002/0004065 A1 1/2002 Kanios
2002/0017295 A1 2/2002 Weers et al.
2002/0034554 A1 3/2002 Hsu et al.
2002/0098239 A1 7/2002 Kuhrts
2002/0142036 A1 10/2002 Rupprecht et al.
2002/0162562 A1 11/2002 Williams
2003/0031630 A1 2/2003 Reznick et al.
2003/0072792 A1 4/2003 Flanigan et al.
2003/0084912 A1 5/2003 Pera
2004/0022836 A1 2/2004 Degen et al.
2004/0028732 A1 2/2004 Falkenhausen et al.
2004/0033255 A1 2/2004 Baker et al.
2004/0096491 A1 5/2004 Tateishi et al.
2004/0156886 A1 8/2004 Kose
2004/0202708 A1 10/2004 Roehrig et al.
2004/0219198 A1 11/2004 Johnson et al.
2004/0224012 A1 11/2004 Suvanprakorn et al.
2004/0258753 A1 12/2004 Demeester et al.
2005/0004036 A1 1/2005 Rodgers et al.
2005/0084459 A1 4/2005 Reznick et al.
2005/0118246 A1 6/2005 Wong et al.
2005/0136112 A1 6/2005 Gonzales et al.
2005/0172976 A1 8/2005 Newman et al.
2005/0175676 A1 8/2005 Suzuki et al.
2005/0208116 A1 9/2005 Stefano et al.
2005/0241658 A1 11/2005 Pera
2005/0260255 A1 11/2005 Terahara et al.
2006/0073190 A1 4/2006 Carroll et al.
2006/0078604 A1 4/2006 Kanios et al.
2006/0110415 A1 5/2006 Gupta
2006/0110449 A1 5/2006 Lorber et al.
2006/0137702 A1 6/2006 Karerat et al.
2006/0141031 A1 6/2006 Nelson et al.
2006/0144412 A1 7/2006 Mishra et al.
2006/0147498 A1 7/2006 Jonsson et al.
2006/0167039 A1 7/2006 Nguyen et al.
2006/0174901 A1 8/2006 Karles et al.
2006/0188554 A1 8/2006 Nakashima et al.
2006/0191548 A1 8/2006 Strickland et al.
2006/0204598 A1 9/2006 Thompson
2006/0228418 A1 10/2006 Mitchell
2006/0237024 A1 10/2006 Reich et al.
2006/0243290 A1 11/2006 Reich et al.
2007/0000505 A1 1/2007 Zhuang et al.
2007/0012328 A1 1/2007 Winterson et al.
2007/0026025 A1 2/2007 Mitchell
2007/0062548 A1 3/2007 Horstmann et al.
2007/0062549 A1 3/2007 Holton et al.
2007/0074733 A1 4/2007 Rasouli et al.
2007/0095356 A1 5/2007 Winterson et al.
2007/0122526 A1 5/2007 Sweeney et al.
2007/0125765 A1 6/2007 Nelson
2007/0186941 A1 8/2007 Holton et al.
2007/0186942 A1 8/2007 Strickland et al.
2007/0186943 A1 8/2007 Strickland et al.
2007/0186944 A1 8/2007 Strickland et al.
2007/0190157 A1 8/2007 Sanghvi et al.
2007/0207239 A1 9/2007 Neidle et al.
2007/0225378 A1 9/2007 Ishida et al.
2007/0261707 A1 * 11/2007 Winterson et al. .... A24B 13/00 131/357
2007/0280892 A1 12/2007 Kindel et al.
2007/0298061 A1 12/2007 Boghani et al.
2008/0014303 A1 1/2008 Jacops et al.
2008/0029110 A1 2/2008 Dube et al.
2008/0029116 A1 2/2008 Robinson et al.
2008/0029117 A1 2/2008 Mua et al.
2008/0063748 A1 3/2008 Massey et al.
2008/0081071 A1 4/2008 Sanghvi et al.
2008/0102157 A1 5/2008 Hofacker et al.
2008/0131467 A1 6/2008 Nelson et al.
2008/0202533 A1 8/2008 Mishra et al.
2008/0202536 A1 8/2008 Torrence et al.
2008/0299249 A1 12/2008 Hirt et al.
2008/0308115 A1 12/2008 Zimmermann
2008/0317911 A1 12/2008 Schleef et al.

(56) References Cited

U.S. PATENT DOCUMENTS

| | | | |
|---|---|---|---|
| 2009/0004329 | A1 | 1/2009 | Gedevanishvili et al. |
| 2009/0022856 | A1 | 1/2009 | Cheng et al. |
| 2009/0022917 | A1 | 1/2009 | Gedevanishvili et al. |
| 2009/0025740 | A1 | 1/2009 | Chappell, Sr. et al. |
| 2009/0025741 | A1 | 1/2009 | Crawford et al. |
| 2009/0032040 | A1 | 2/2009 | Luzenberg, Jr. |
| 2009/0038631 | A1 | 2/2009 | Mishra et al. |
| 2009/0038681 | A1 | 2/2009 | Trancik et al. |
| 2009/0175982 | A1 | 7/2009 | Boghani et al. |
| 2009/0301505 | A1 | 12/2009 | Liu et al. |
| 2010/0018883 | A1 | 1/2010 | Patel |
| 2010/0108086 | A1 | 5/2010 | Reznick et al. |
| 2010/0300464 | A1 | 12/2010 | Gee et al. |
| 2012/0052021 | A1 | 3/2012 | Kobal et al. |

FOREIGN PATENT DOCUMENTS

| | | | |
|---|---|---|---|
| GB | 2337933 | A | 12/1999 |
| JP | 2004-229627 | A | 8/2004 |
| JP | 2005-508648 | A | 4/2005 |
| JP | 2009-523672 | A | 6/2009 |
| WO | WO-99/39595 | A1 | 8/1999 |
| WO | WO-2003/041521 | A2 | 5/2003 |
| WO | WO-2007-084587 | A2 | 7/2007 |
| WO | WO-2008-057963 | A2 | 5/2008 |
| WO | WO-2008090552 | A2 | 7/2008 |
| WO | WO-2009/015142 | A2 | 1/2009 |
| WO | WO-2010014506 | A2 | 2/2010 |

OTHER PUBLICATIONS

Kichko et al., "Irritant? Included CGRP Release from the Isolated Mouse Trachea and Role of TRP Channels," Acta Physiologica 2007; vol. 189, Supplement 653. P20-L1-03 (2007).

Park et al., "Noncompetitive Inhibition by Camphor of Nicolinic Acetylcholine Receptors," Biochem Pharmacol. 61 (2001) 787-793.

Bautista et al., "Pungent Products from Garlic Activate the Sensory Ion Channel TRPA1" 102 Proc. Nall. Acad. Sci U.S.A. 12248-52 (2005).

Salazar et al., "A Single N-Terminal Cysteine in TRPV1 Determines Activation by Pungent Compounds From Onion and Garlic" 11 Nat. Neurosci. 255-61 (2008).

Hinman et al., "TRP Channel Activation By Reversible Covalent Modification" 103 Proc. Natl. Acad. Sci U.S.A. 19564-68 (2006).

Susankova et al., "Reducing and Oxidizing Agents Sensitize Heat-Activated Vanilloid Receptor (TRPV1) Current" 70 Mol. Pharmacol. 383-94 (2006).

Mar. 26, 2012 International Search Report for International Application No. PCT/IB2011/000994.

Hillis et al., "Polyphenols in the Leaves of Eucalyptus L'Herit: A Chemotaxonomic Survey-I," Phytochemistry, vol. 5, No. 6, 1075-1090 (Nov. 1966).

Database WPI, Thomson Scientific, London, GB, An 2005-372696 XP000002658810, & CN 1 579 258 A (Wang Ziyong) Feb. 16, 2005.

Craven, R., Ions Channels: The Comfort of Camphor, Nature Review Neuroscience, 6 pages, 826 (1-3), Nov. 2005.

Mar. 26, 2012 Written Opinion of the Internatinal Searching Authority, PCT/IB2011/000994.

Sep. 27, 2011 International Search Report for International Application No. PCT/IB2011/001093.

Office Action issued on Apr. 1, 2015, by the Russian Patent Office in corresponding Russian Patent Application No. 2012145549, and an English Translation of the Office Action. (7 pages).

Office Action issued on Mar. 12, 2015, by the Japanese Patent Office in corresponding Japanese Patent Application No. 2013-500612, and an English Translation of the Office Action. (15 pages).

Office Action mailed Oct. 25, 2017 in corresponding European Patent Application No. EP11728390.3, 4 pages.

Office Action mailed May 15, 2017 in corresponding Korean Patent Application No. 10-2012-7027943 with English Translation, 13 pages.

Talavera et al., "Nicoline activates the chemosensory cation channel TRPA1", Nature Neuroscience (2009), vol. 12, No. 10, pp. 1293-1300.

Office Action issued on Apr. 3, 2017 by the Canadian Patent Office in corresponding Canadian Patent Application No. 2,794,333 (4 pages).

Office Action issued on Oct. 30, 2017 by the Canadian Patent Office in corresponding Canadian Patent Application No. 2,794,333 (4 pages).

* cited by examiner

INHIBITION OF SENSORY IRRITATION DURING CONSUMPTION OF NON-SMOKEABLE TOBACCO PRODUCTS

CROSS-REFERENCE TO RELATED APPLICATION

This application is a continuation of U.S. patent application Ser. No. 16/179,107, filed Nov. 2, 2018, which is a divisional of U.S. patent application Ser. No. 14/719,510, filed May 22, 2015, which is a continuation of U.S. patent application Ser. No. 13/290,768, filed Nov. 7, 2011, now issued as U.S. Pat. No. 9,038,643 on May 26, 2015, which is a continuation of U.S. patent application Ser. No. 13/071,825, filed Mar. 25, 2011, now abandoned, which claims priority under 35 U.S.C. § 119(e) to U.S. Provisional Application No. 61/318,268, filed on Mar. 26, 2010, the entire contents of each of which are incorporated herein by reference thereto.

SUMMARY

An orally-enjoyable tobacco product includes a portion of smokeless tobacco comprising an active ingredient and either: (1) a collection of tobacco particles at least partially enclosed by a coating comprising a water-soluble non-crosslinked component and a substantially water-insoluble cross-linked component, or (2) a pouch comprising smokeless tobacco enclosed in a water-permeable wrapper; wherein the active ingredient is selected from the group consisting of a mercaptan, camphor, borneol, isoborneol, bornyl acetate, isobornyl acetate, mono-bornyl succinate, mono-isobornyl succinate, mono-bornyl formate, and mono-isobornyl formate, and wherein the active ingredient is present in an amount effective to reduce or eliminate the sensory irritation arising from the smokeless tobacco.

An embodiment includes a method of making an orally-enjoyable tobacco product. The method includes combining tobacco with an active ingredient selected from the group consisting of a mercaptan, camphor, borneol, isoborneol, bornyl acetate, isobornyl acetate, mono-bornyl succinate, mono-isobornyl succinate, mono-bornyl formate, and mono-isobornyl formate to create one or more portions of smokeless tobacco. The active ingredient is present in an amount effective to reduce or eliminate sensory irritation arising on oral enjoyment of the product.

BRIEF DESCRIPTION OF THE DRAWINGS

FIG. 4A shows combined results from all time periods, and FIGS. 4B, 4C, and 4D show results at two, five, and ten minutes, respectively.

FIG. 5 contains illustrations of exemplary oral pouch products as described herein.

DETAILED DESCRIPTION

Figure 1A:
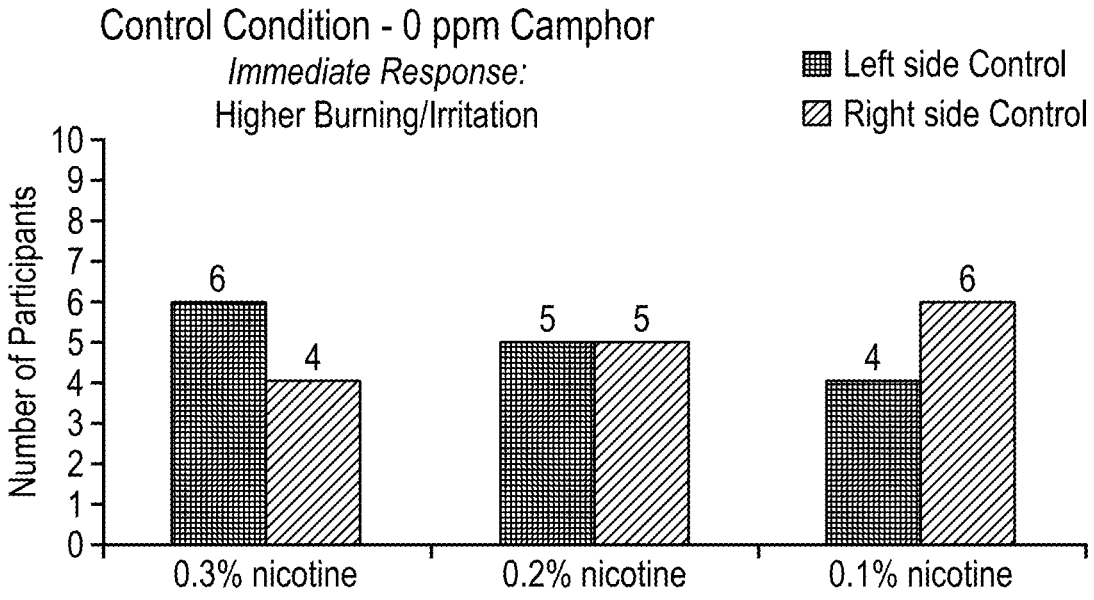
FIGS. 1A, 1B, 1C, and 1D show results on the effect of pre-treatment with camphor on immediately-perceived sensory irritation from nicotine with 0 ppm, 25 ppm, 50 ppm, or 100 ppm of camphor, respectively.
Figure 1B:
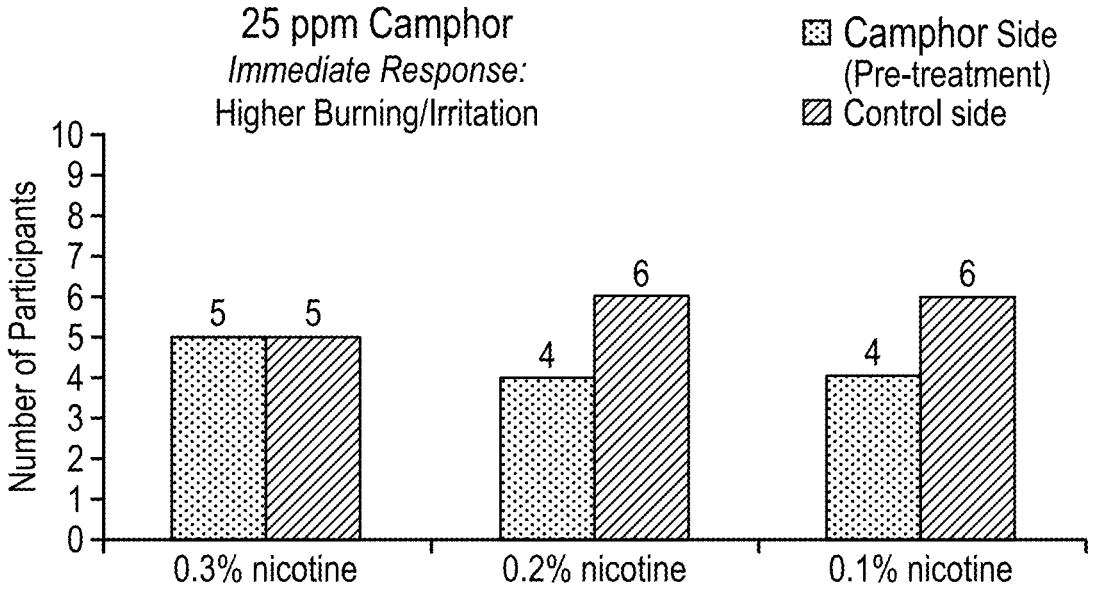
Figure 1C:
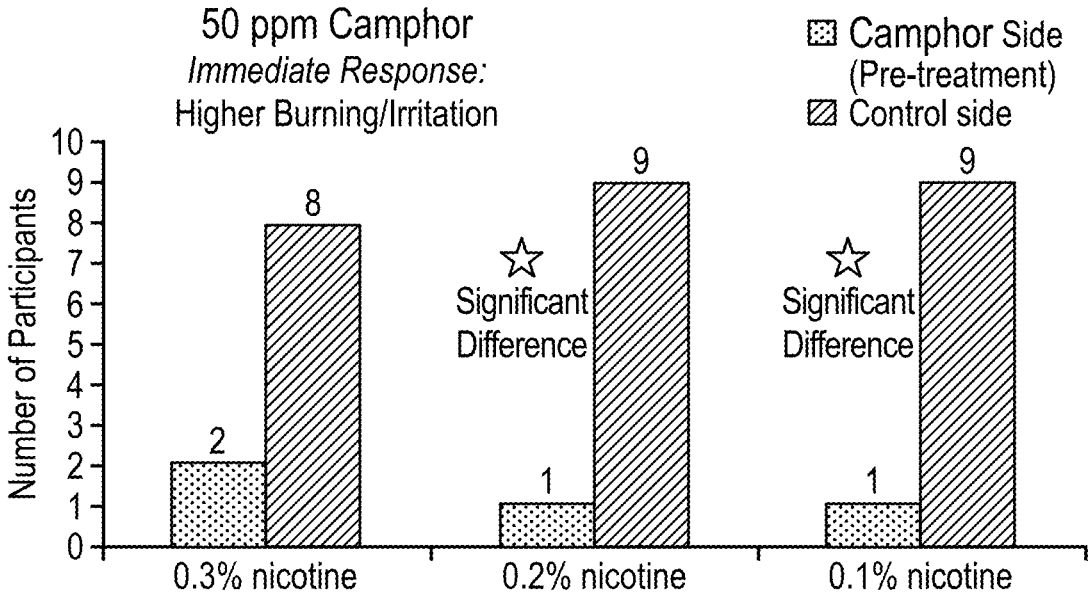
Figure 1D:
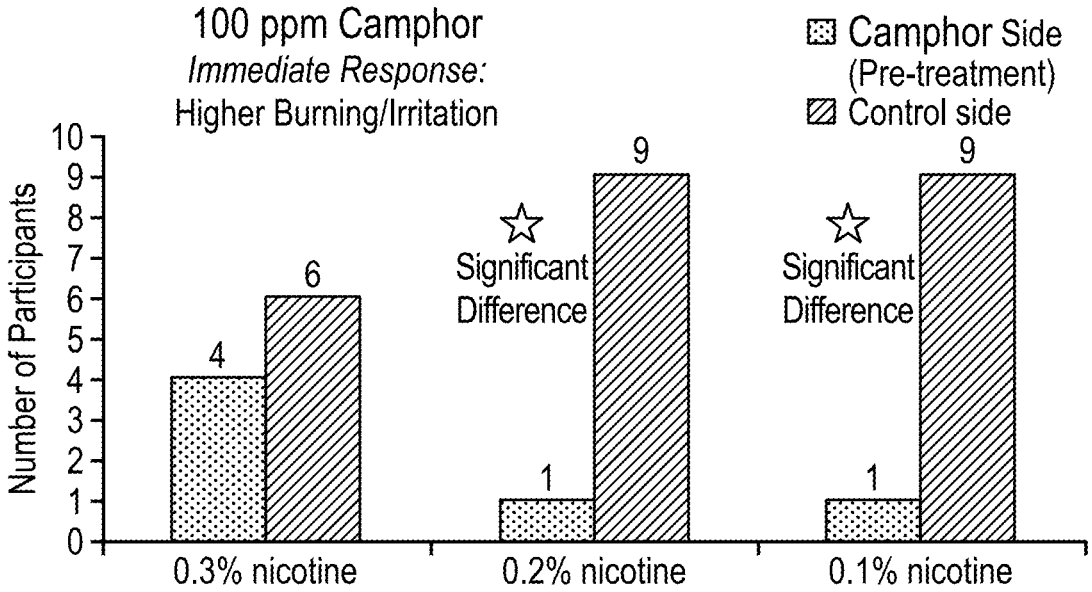
Figure 2A:
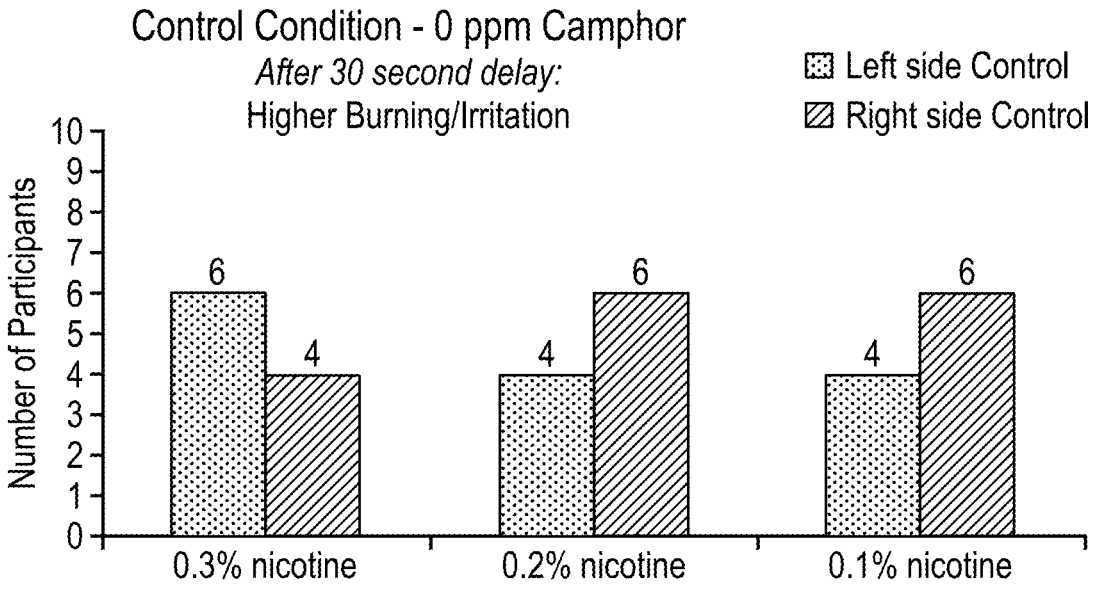
FIGS. 2A, 2B, 2C, and 2D show results on the effect of pre-treatment with camphor on sensory irritation from nicotine after 30 seconds, using 0 ppm, 25 ppm, 50 ppm, or 100 ppm of camphor, respectively.
Figure 2B:
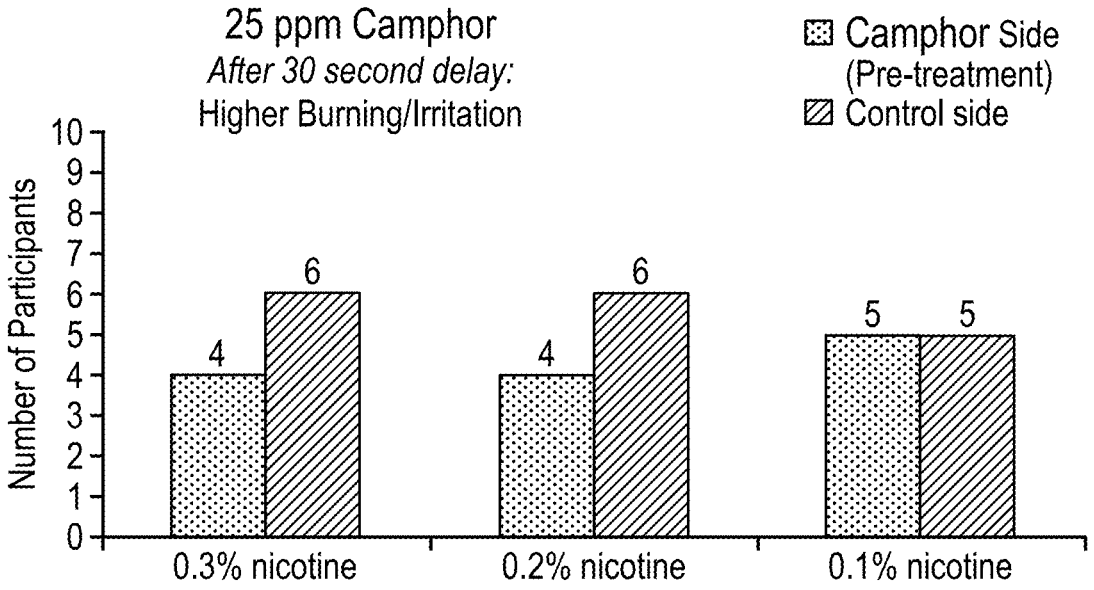
Figure 2C:
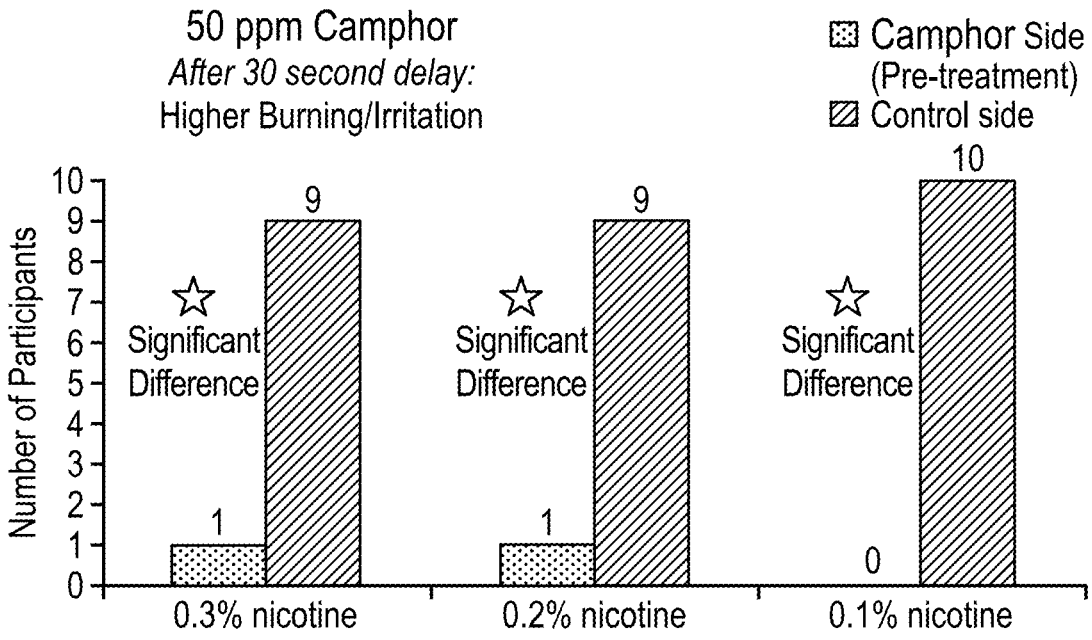
Figure 2D:
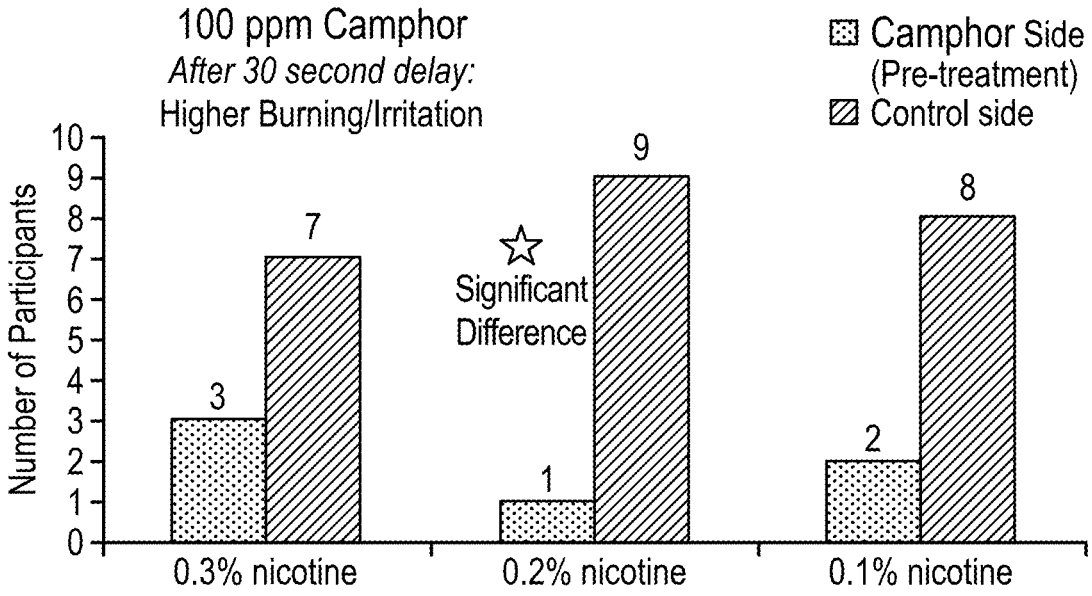
Figure 3A:
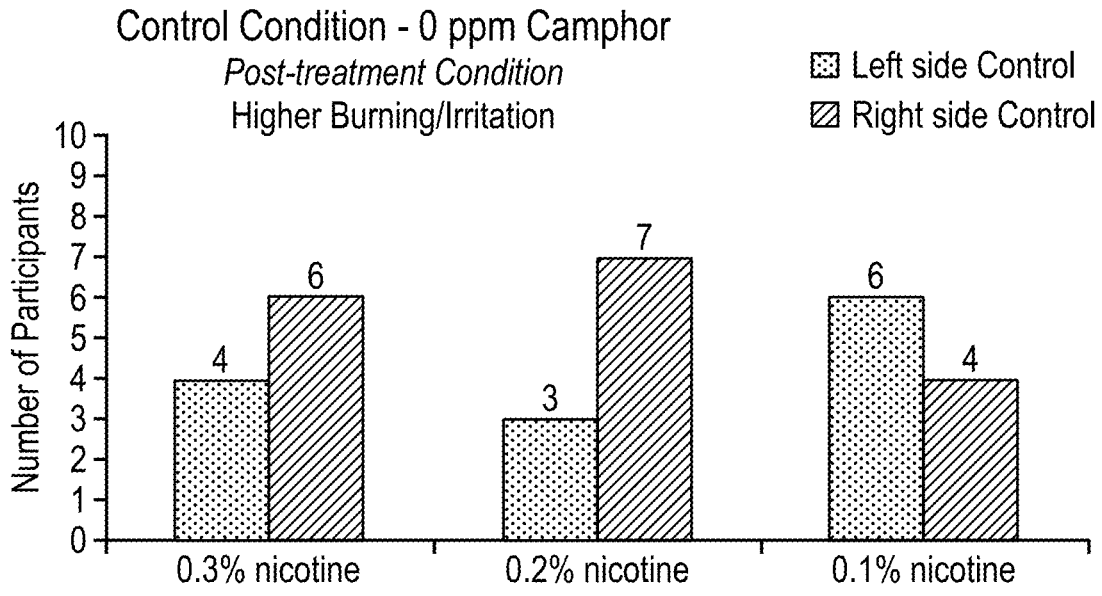
FIGS. 3A, 3B, 3C, and 3D show results on the effect of post-treatment with camphor on sensory irritation from nicotine using 0 ppm, 25 ppm, 50 ppm, or 100 ppm of camphor, respectively.
Figure 3B:
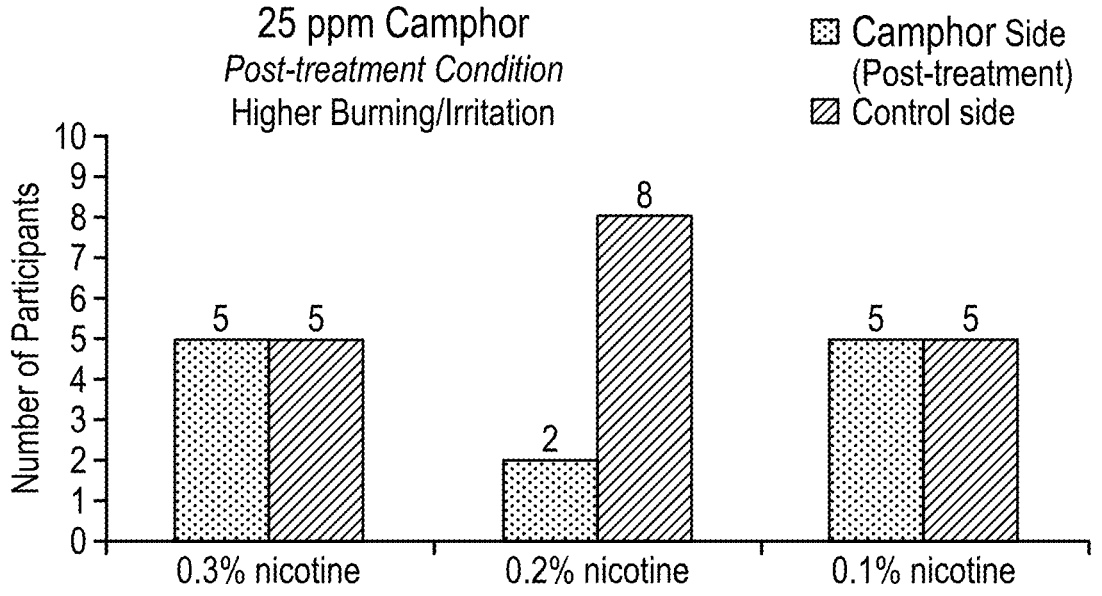
Figure 3C:
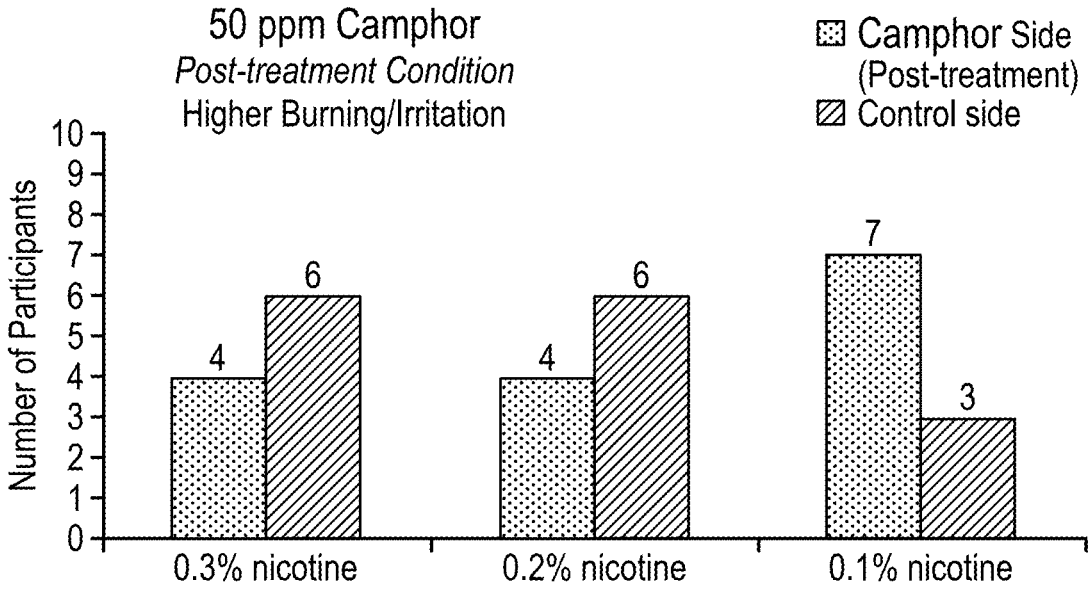
Figure 3D:
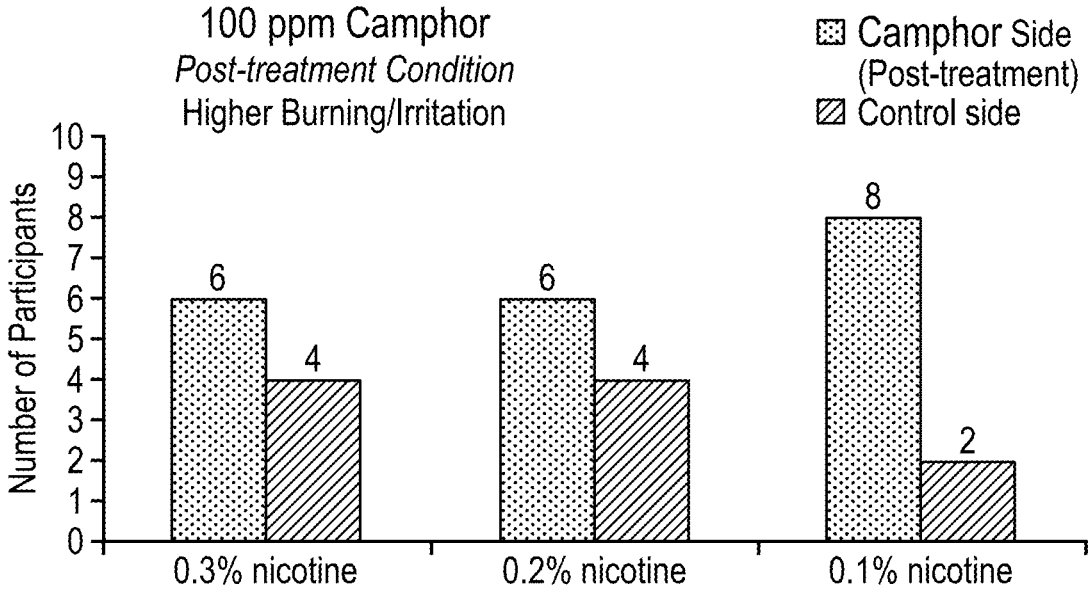

The present application describes the employment of certain active ingredients to achieve reduction or elimination of sensory irritation arising from the consumption of orally-enjoyable tobacco products containing one or more chemical irritants.

As used herein, the terms "particle" or "particles" denote any subdivided form of plant material (such as tobacco), and can include flakes, granules, powders, chopped stems, leaves, flowers, or other pieces, as well as extracts and derivatives thereof.

As used herein, the term "portions of smokeless tobacco" (also called pre-portioned tobacco) denotes pouched tobacco (snus pouches) as well as orally enjoyable tobacco that has been molded or divided into individual servings prior to use, such that the pre-portioned tobacco can be placed in a user's mouth without the need for the user to determine an amount to use. It is intended to include collections of particles that have been pressed or molded or otherwise formed into one or more shapes that are convenient for a user to recognize, manipulate, and/or comfortably insert into the oral cavity and consume, and which contain an amount of tobacco similar to that commonly used by users of moist smokeless products. The term "pre-portioned tobacco material" as used herein refers to the tobacco exclusive of the coating. The term "pre-portioned product" as used herein refers to the coated product as a whole, i.e., to the pre-portioned tobacco material, and its coating.

As used herein, the term "substantially water-insoluble" denotes a material that has a significantly lower solubility in water than the non-cross-linked water-soluble polymers described herein.

As used herein, the term "smokeless tobacco" denotes orally enjoyable tobacco products, including moist smokeless tobacco ("MST") in orally used pouches (snus pouches).

As used herein, the term "sensory irritation" includes itching, burning, and the like.

As used herein, the term "about" when used in conjunction with a stated numerical value or range denotes somewhat more or somewhat less than the stated value or range, to within a range of ±10% of that stated.

As used herein, reference to an amount of active ingredient in a consumable product refers to the amount in an individual portion of the product as typically enjoyed by the consumer.

Tobacco tends to contain compounds that contribute to sensory irritation, i.e., irritants. Such irritants may include one or more agonists of nicotinic acetylcholine receptors and/or of vanilloid receptor (such as TRPV1 and/or TRPA1 receptors). As used herein, the term "agonist(s)" include partial agonists and mixed agonists-antagonists. Non-limiting examples of nicotinic agonists are nicotine, epibatidine, lobeline, and varenicline. Furthermore, nicotine was found to sensitize TRPV1 receptors (*J. Neurophysiol.,* 91: 1482-1491, 2004), increasing their responsiveness, as well as TRPA1 receptors.

Non-smokeable (smokeless) consumable products include tobacco products such as pouched tobacco and other forms of pre-portioned tobacco, described below. When products containing a chemical irritant (e.g., an agonist of nicotinic acetylcholine receptors or of vanilloid receptors such as TRPV1 and/or TRPA1 receptors) are enjoyed in the absence of active ingredients as described herein, the products may cause undesirable sensory irritation and other undesired effects such as nausea.

Nicotinic acetylcholine receptors are located on a variety of nerve endings in the peripheral nervous system and play a role in transmission of sensations of irritation (e.g. burning) to the brain. As a result of activation of these receptors, consumers of some products (such as smokeless tobacco) sometimes experience irritation of the mouth, throat, esophagus, stomach, larynx, trachea, etc. when using a non-smokeable tobacco product. Nicotine and other agonists dissolve in the saliva, activate nicotinic acetylcholine receptors and/or sensitize vanilloid receptors, and thereby produce the undesired sensation where they contact the mucosa of the gastro-intestinal tract and of parts of the respiratory tract. The unwanted effects of these products go beyond sensory irritation (e.g. burning) and may include nausea, hiccups, and, in rare cases, vomiting induced by swallowed saliva.

The active ingredient preferably serves to reduce or eliminate sensory irritation arising from chemical irritants in consumable products in tobacco and tobacco extracts.

One of the inventors found that the active ingredient camphor can effectively inhibit activation of nerve fibers induced by the nicotinic agonist nicotine in an isolated mouse trachea model. See Kichko et al., Acta Physiologica 2007; Volume 189, Supplement 653, Abstract No. P20-L1-03. Certain other active ingredients can also provide such inhibition by being converted to camphor on human consumption (e.g., by metabolic enzymes). Possible active ingredients include camphor, borneol, isoborneol, bornyl acetate, isobornyl acetate, mono-bornyl succinate, mono-isobornyl succinate, mono-bornyl formate, mono-isobornyl formate, derivatives thereof, and/or a combination thereof.

The addition of camphor to pouches of smokeless tobacco can reduce the sensation of burning at the pouch location as well as along the path of saliva that had been in contact with the pouch. Moreover, camphor can reduce undesirable unpleasant sensations in the esophagus as well as nausea and hiccups arising from use of the smokeless tobacco pouches.

Camphor Reduced Sensory Irritation from Nicotine

FIGS. 1 and 2 show the results of a study on the effect of pre-treatment with camphor on sensory irritation from nicotine. Camphor was applied to tongues of human volunteers prior to application of a nicotine solution. Randomized sides of tongues were selected for application of 20 microliters of 0 ppm, 25 ppm, 50 ppm, or 100 ppm of camphor on a strip (thus, about 0, 500, 1000, or 2000 picograms, respectively) for 30 seconds. Then, the subjects sipped, rinsed, then spit 0.1%, 0.2%, or 0.3% of a nicotine solution for a 5 second application. Participants were then asked which side of the tongue has the strongest burning sensation. Responses were collected both immediately (within 5 seconds) (FIG. 1) and after 30 seconds (FIG. 2). Controls received no camphor, and a baseline was established at zero camphor.

FIG. 3 shows results of a study on the effect of post-treatment with camphor on sensory irritation from nicotine. The study was generally conducted as described above for pre-treatment with camphor, however in this instance the nicotine was provided 30 seconds before the camphor or zero-camphor control. Randomized sides of tongues were selected for application of 20 microliters of 0 ppm, 25 ppm, 50 ppm, or 100 ppm of camphor on a strip (thus, about 0, 500, 1000, or 2000 picograms, respectively) for 30 seconds.

It can be seen from these data that the pre-treatment with camphor significantly reduced perceived burning from nicotine, both immediately and 30 seconds after initial exposure.

Preferably, the active ingredient is present in a quantity so that it does not exhibit a sensory effect by itself (for example, excessive cooling, detectable smell, and/or taste). Alternately, the product may be formulated so as to take advantage of inherent organoleptic properties of the active ingredient.

Threshold of Irritation from Camphor

A further study was conducted to determine the threshold at which camphor itself would cause sensory irritation.

Each test used two milliliters (2 ml) of a camphor solution. The camphor was dissolved in ethanol and further diluted in water. Participants received sequentially increasing concentration of camphor. Nine participants received samples including food grade racemic camphor, with concentrations of 200, 300, 400, 500, 1000, 2000, 4000, 6000 ppm (corresponding to about 400, 600, 800, 1000, 2000, 4000, and 8000 nanograms per sample, respectively).

Participants wore nose clips during evaluation. Each participant sipped the sample, swished it in the mouth for 10 seconds, then spat it out. Each participant then indicated whether irritation was perceived. Between evaluations of each sample, participants rinsed with water and waited for one minute.

Results of the study are listed below in Table 1. The left-most column indicates the participant number of each individual participant. The letter "Y" indicates that the participant felt irritation at the indicated concentration, and the letter "N" indicates that no irritation was felt.

TABLE 1

Determination of irritation threshold of camphor

| # | 200 ppm | 300 ppm | 400 ppm | 500 ppm | 1000 ppm | 2000 ppm | 4000 ppm | 6000 ppm | Notes |
|---|---|---|---|---|---|---|---|---|---|
| 1 | N | N | N | N | Y | Y | | | Felt slight tingling at 500, burning at 1000 |
| 2 | Y | Y | Y | | | | | | Some burning and stinging at 200, tingling and some burning at 300, burning at 400 |
| 3 | Y | Y | Y | | | | | | Very slight tingling at 200, slight tingling at 300, Stronger tingling no burning at 400 |
| 4 | N | N | N | N | N | Y | Y | Y | Felt slight tingling at 2000, some tingling at 4000, burning at 6000 |

TABLE 1-continued

Determination of irritation threshold of camphor

| # | 200 ppm | 300 ppm | 400 ppm | 500 ppm | 1000 ppm | 2000 ppm | 4000 ppm | 6000 ppm | Notes |
|---|---|---|---|---|---|---|---|---|---|
| 5 | N | N | N | N | Y | Y | Y | | Felt some tingling at 1000, stronger tingling at 2000, burning at 4000 |
| 6 | N | N | Y | Y | | | | | Tingling at 300, tingling no burning at 400 |
| 7 | N | N | Y | Y | | | | | Slight tingling and burning at 300 and 400 |
| 8 | N | N | N | Y | | | | | No Burning, slight tingling on edges at 400 |
| 9 | Y | Y | | | | | | | Some burning at 200, stronger burning at 300 |

The study found that the irritation threshold for camphor racemate (D+L) in solution ranges from 200 ppm (slight tingling) to 1000 ppm. Most participants perceived tingling at very low concentrations (200-300 ppm) while a few were sensitive only at higher concentrations (1000-2000 ppm). The mean threshold for producing irritation was 655 ppm for n=9.

Snus Pouches with Camphor

A further study was conducted to determine if camphor affected perceived burning in the mouth of subjects using oral tobacco. Participants were given two snus pouch samples to use simultaneously, one in each side of the mouth. One sample was a control pouch with no camphor added and the other contained various concentrations of camphor (2.3, 6, 12, 23, 46, and 69 nanograms, corresponding to 25, 50, 100, 200, or 300 ppm, based on tobacco weight, respectively).

The hand-made test samples were constructed using unflavored tobacco (12% oven volatiles) to prevent any possible interference of the flavor system with the objective of the study. In preparing the pouches, the camphor was dissolved in 95% ethanol, with the control pouches receiving the ethanol only. Ten (10) microliters of one of the solutions was applied to each sample pouch (5 microliters per side). Using a one (1) microliter pipette, 1 microliter was applied to each corner of the tobacco cavity and the 5th microliter was applied to the center. The same procedure was used for the other side of the pouch. Samples were prepared one day prior to testing and sealed in glass jars overnight. The jars were unsealed each morning of testing to allow volatiles to escape. Unused samples were discarded at the end of each day of testing, and fresh samples prepared for the next day.

The study was carried out as a double-blind, randomized within-subjects two-alternative forced choice (2AFC) design.

In each session, participants were given two (2) test samples (one being a control). Participants were instructed to place one (1) of the two (2) pouches between their gums and upper lip on the left side of the mouth, and place the other pouch between the gums and upper lip on the right side of the mouth. Pouch placement was targeted to the area just below and in front of the cheek bone. The control pouch side was randomly assigned. Participants were instructed to close their mouth and leave the pouches in the locations they were placed. Participants were allowed to squeeze the pouches with their cheeks and wet the pouches with their saliva in order to release additional flavor.

After two (2) minutes, five (5) minutes, and ten (10) minutes of using the samples, participants were asked to indicate which side of the mouth was burning more. Responses were recorded on paper by the experimenter. After participants finished the evaluation, they were instructed to spit the test samples out of their mouths into the provided receptacle. They were provided with water and/or orange juice to cleanse their palates. Following each evaluation, participants were asked to give details regarding where the burning was felt and to provide any open-ended comments regarding their experience, which were recorded on paper by the experimenter. Participants repeated the sensory evaluation procedures an additional six (6) times, with a maximum of two (2) pairs being evaluated each day.

Figure 4A:
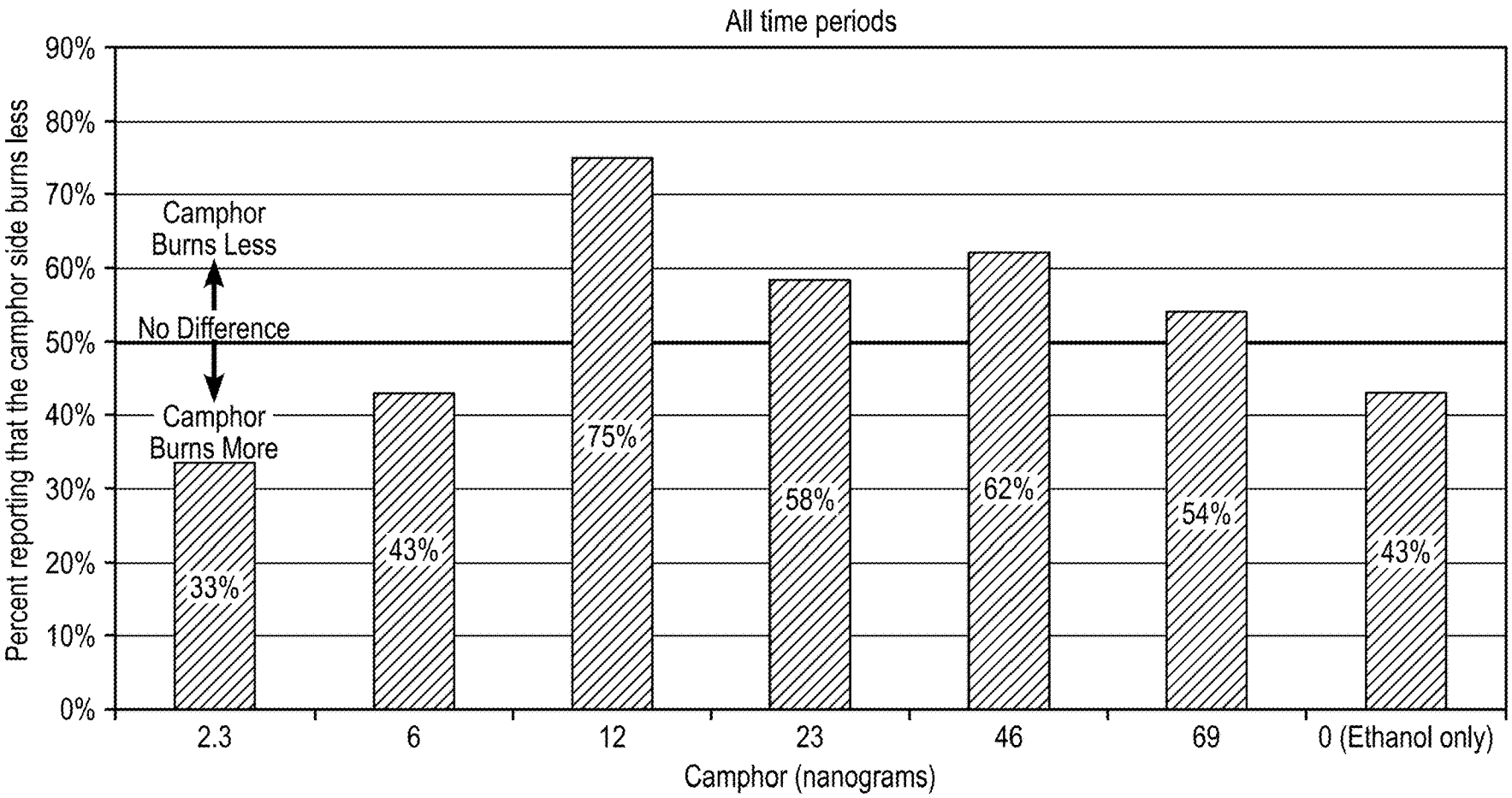
FIGS. 4A and 4B show results of a study to determine whether camphor affected perceived irritation in the mouth from use of snus in adult smokers who are novice oral tobacco users.
Figure 4B:
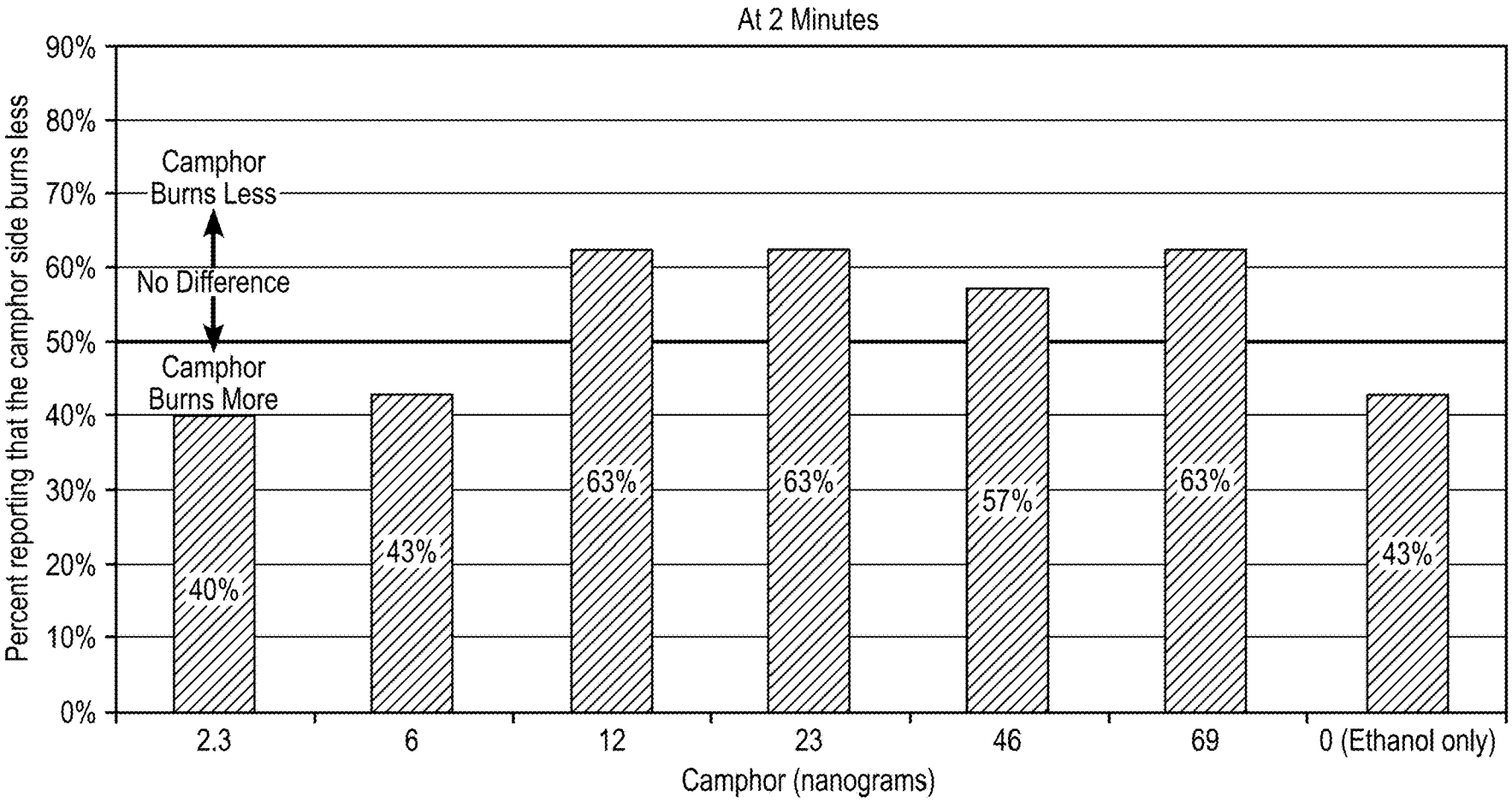
Figure 4C:
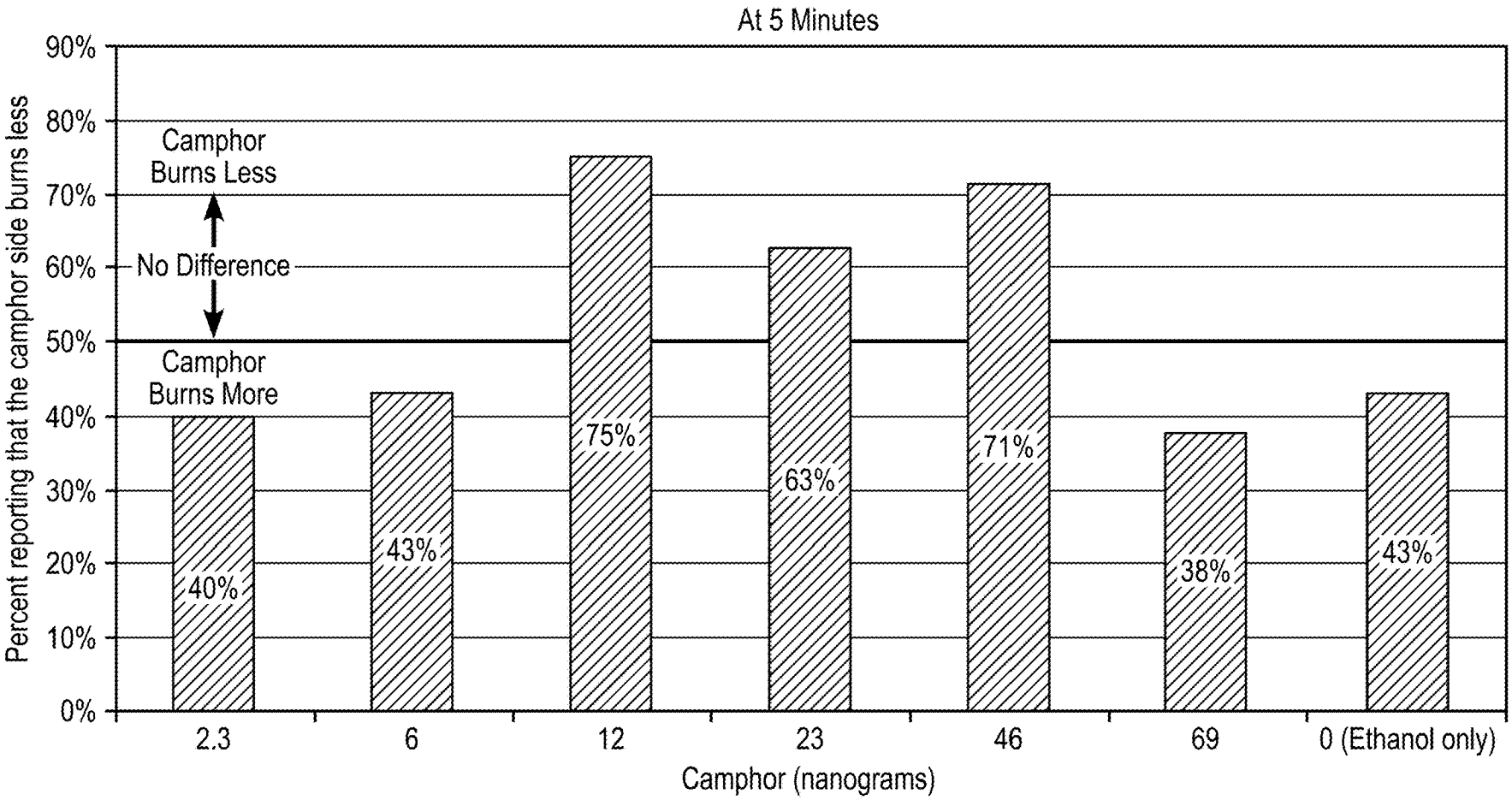
Figure 4D:
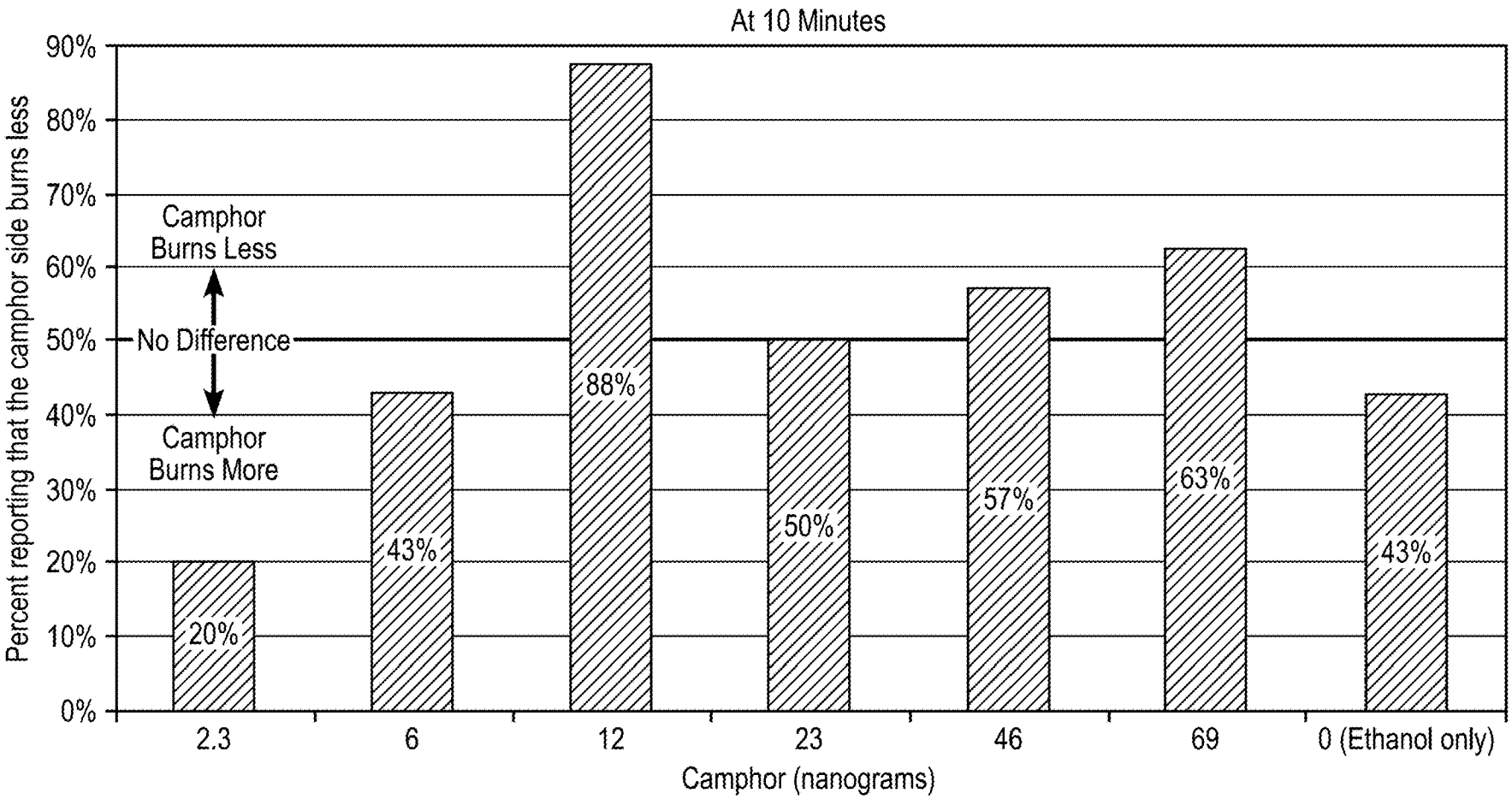

Participants were asked which side of the mouth burned more at 2, 5, and 10 minutes, as seen in FIGS. 4B, C, and D, respectively. FIG. 4A shows results across all times points. The 12 nanogram (corresponding to 50 ppm) quantity of camphor was most effective in reducing oral burning, and the effect was strongest at the 10-min mark.

In view of all of the above results, it is preferable to supply an amount of camphor less than that contained in 2 ml of 200 ppm solution (i.e., less than about 400 nanograms). This amount can be increased if the camphor is provided in a form that supplies sustained release, such as an encapsulated form as described below. Thus, in order to achieve reduced or eliminated burning and other sensory irritation arising from nicotine while reducing or eliminating irritation caused from the camphor itself, an orally-enjoyable tobacco product preferably provides about 500 picograms to about 4 milligrams of camphor in each individual application (e.g., in the case of pouched products, in each pouch). More preferably, the amount is about 500 picograms to about 400 nanograms. Even more preferably, the product contains about 2 nanograms to about 20 nanograms of camphor, or about 10 nanograms to about 15 nanograms.

Camphor is further known to have inherent anti-microbial properties that could provide a preservative effect to the product in which it is incorporated, especially if the camphor is not encapsulated. These properties might be shared by some or all of the above-described compounds related to camphor.

The active ingredient may preferably be encapsulated for release upon contact with saliva. Camphor and beta-cyclodextrin readily form an inclusion complex wherein the former is stabilized within the cavity of the host cyclodextrin. Materials other than cyclodextrin can also be used to encapsulate camphor and the other active ingredients. Encapsulation is expected to prevent loss of camphor, which is somewhat volatile, thereby increasing shelf stability and consistency of the product incorporating the encapsulated active ingredient.

Beta-cyclodextrin can form a 1:1 complex with camphor resulting in a white solid. To encapsulate the camphor, beta-cyclodextrin can be dissolved in a minimum amount of hot water and the camphor dissolved in a minimum amount of alcohol, then added to the cyclodextrin. The mixture is then heated to no more than about 75° C. until all solids have dissolved. Upon cooling to about 4° C., precipitated solid encapsulated camphor can be recovered. The encapsulated material can then be applied to the surface of a tobacco product, preferably using a food glue.

Instead of, or in addition to, an active ingredient from the camphor family, the active ingredient may preferably be a mercaptan. Namely, it may be a mercaptan present in an amount effective to reduce or eliminate the sensory irritation arising from a chemical irritant, e.g., present in the product in an amount sufficient to activate TRPV1 and/or TRPA1 receptors, two vanilloid receptors responsible for noxious perception, in a consumer of the product.

Chemical irritants in the form of reducing agents have been demonstrated to activate TRPV1 and TRPA1 receptors through covalent modification of specific sulfhydryl groups in the receptors. Addition of one or more mercaptans could ameliorate the burning effects of the irritants by substituting as a reacting group, thereby alleviating "throat burn" or "throat grab" often described with oral tobacco products.

A preferred mercaptan is furfuryl mercaptan ("FFM"), a compound that is also on the list of "Everything" Added to Food in the United States ("EAFUS") maintained by the U.S. Food and Drug Administration. It is used in coffee as a flavor enhancer. FFM has a free sulfhydryl group that could react with irritants to prevent activation of the vanilloid receptors by sequestering the irritants. At less than 1 ppm, FFM has been described as tasting like roasted coffee and slightly nutty with savory meat nuances. Addition of this compound to orally-enjoyed tobacco products could not only reduce the scratchy burning sensation perceived by consumers, but also provide a desirable flavor. The EAFUS list contains other mercaptans besides FFM that may also be used as an active ingredient as described herein. For example, benzyl, methyl, and propyl mercaptans are available and might be used.

Portions of Smokeless Tobacco

As described herein, portions of smokeless tobacco include both pouched tobacco (sometimes called snus pouches) and portions that are preferably free of a fabric and/or paper wrapper and comprise orally enjoyable tobacco that has been molded or divided into individual servings prior to use, such that the pre-portioned tobacco can be placed in a user's mouth without the need for the user to determine an amount to use. Forms of pre-portioned tobacco are described in, for example, commonly-assigned U.S. Patent Publication Nos. 2009/0038631, 2008/0202533, and 2009/0301505, each of which is incorporated herein by reference in its entirety.

Preferably, the portion has a generally rectangular or elliptical shape. Other preferred shapes for the pouch include any shape selected from the group consisting of polygons, squares, rectangles, circles, ovals, heart, star, half-moon, crescent, leaf shapes, and combinations thereof.

In a preferred embodiment, the portion is sized and configured to fit inside the mouth, between a user's cheek and gum. Preferably, the pouch takes a generally rectangular shape and is about 20 mm to about 35 mm long, about 10 mm to about 20 mm wide and about 3 mm to about 6 mm thick. The corners of the portion may be preferably rounded.

Pouches

Figure 5A:
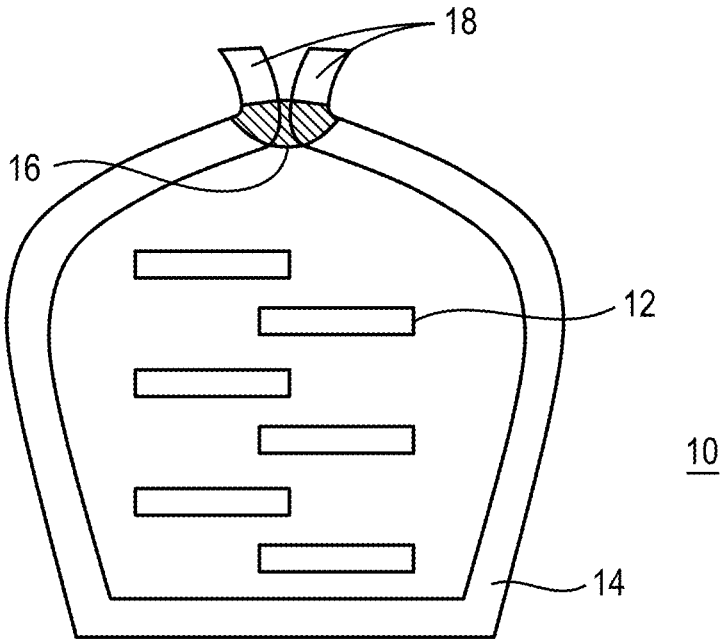
FIG. 5A shows a pouch product with a soft edge and FIG. 5B shows a traditional pouch product.
Figure 5B:
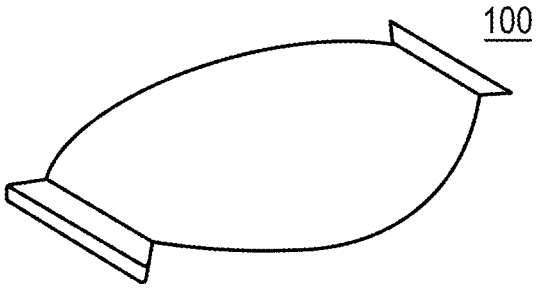

A preferred embodiment of an orally-enjoyable tobacco product is an oral pouch product 10 or 100, shown in FIGS. 5A and 5B. FIG. 5A shows a pouch product with a soft edge and FIG. 5B shows a traditional pouch product. Preferably, the oral pouch product can be sucked, chewed and/or orally manipulated when placed in a user's mouth to release flavorants contained therein.

In one embodiment having a soft edge, as shown in FIG. 5A, the oral pouch product 10 includes a porous pouch wrapper 14 enclosing an inner filling material 12, and sized to fit comfortably in the mouth. At least one seam 16 closes an opening of the pouch, which contains inner filling material 12 within the porous pouch wrapper 14. Preferably, the seam 16 does not extend to the free edges of the porous pouch wrapper 14 so as to leave a soft, unbonded area 18 which increases comfort of sensitive mouth tissue.

When used with an oral pouch product, the active ingredient may be provided in several manners, singly or in combination. The ingredient may be provided as part of a film or layer of the pouch, as disclosed in U.S. Patent Application Publication 2007/0012328. The ingredient may also be included along with or in place of a flavorant embedded in a fibrous wrapper, as disclosed in U.S. Patent Application Publication 2008/0202536. The ingredient may also be incorporated into a lined pouch product as described in U.S. Patent Application Publication 2007/0261707. Each of the above-referenced U.S. patent application Publications, commonly-assigned with the present application, is incorporated by reference in its entirety.

Preferably, the active ingredient is provided towards an outside of the pouch product relative to a filling comprising a nicotinic agonist (e.g., a filling of tobacco) in order to be released into the mouth prior to the contents of the pouch. To this end, the active ingredient is preferably on or within the porous pouch wrapper, for example in a dissolvable coating applied to the outside or inside of the wrapper, or both, or in which the wrapper is embedded. The active ingredient is preferably encapsulated.

In a preferred embodiment, the inner filling material 12 (for example, tobacco, possibly together with optional ingredients such as one or more flavorings, sweeteners, humectants, etc.) completely fills the interior of the pouch wrapper 14. In another embodiment, the inner filling material 12 partially fills the interior of the pouch wrapper 14.

Preferably, the oral pouch product is sized and configured to fit comfortably in a user's mouth. Preferably, the oral pouch product delivers a plurality of flavor and/or functional ingredients to the user for a period of about one minute to about 1 hour. Preferably, the pouch is discarded after a single use.

In an embodiment, the oral pouch product has maximum dimensions of about 0.1 inches to about 2.0 inches. In an embodiment, the oral pouch product weighs between about 0.2 g and 5.0 g. The weight predominately comes from the weight of the enclosed inner filling material 12.

In a preferred embodiment, the wrapper of the oral pouch product is made of a porous material that can optionally also include a flavorant. In addition, the coating can include functional or salivation-inducing ingredients. Preferably, the porous material allows flavors and saliva-soluble ingredients contained in the inner filling material 12 to diffuse out of the pouch wrapper 14 and into the user's mouth. Preferred porous materials include, but are not limited to, films, gelatin, food casings, carrageenan, biopolymers, fabric, and/or paper (such as filter paper, papers used to construct tea bags, coffee filters, and the like). Preferably, the pouch wrapper 12 is of the type suitable for contact with food, such as materials used for packaging and/or handling foods.

Also provided is a method of making an oral pouch product having a soft edge, as disclosed in commonly-assigned U.S. Patent Publication No. 2009/0025740, the entirety of which is incorporated herein by reference. The method includes forming a wrapper into an open pouch using a vertical or horizontal fill machine and filling the open pouch with an inner filling material. The pouch is then sealed to contain the inner filling material and form an oral pouch product. Preferably, a series of pouches are formed with a space between seals of adjacent pouches and then cut apart to form individual pouch products. For instance, the pouch product may be cut with a die at a location between adjacent seals so as to form a soft edge on each pouch product. In an alternative embodiment, the seal can be formed at a distance from the edge of the wrapper material when the wrapper material being used is previously cut to size.

Alternatively, a first strip of pouch wrapper material can be advanced along a feed path, filling material in matrix form can be placed on the strip, a second strip can be placed over the first strip, a sealing die can be used to press the strips together and form a seam such as a heat seal or adhesive seal around the filling, and a cutting die can be used to cut the first and second strips outwardly of the seam to form the soft edge.

Portions with a Semi-Dissolvable Coating

In an embodiment, a tobacco product has a semi-dissolvable coating, such as a super-hydrated, monolayer membrane, at least partially enclosing a collection of tobacco particles. Such portions preferably do not have a wrapper. The coating is a two-component coating that coats a portion of tobacco material, preferably in a single layer. The two-component coating includes water-soluble, non-cross-linked component and a cross-linked polymer component. The cross-linked polymer is substantially water-insoluble. Optionally, the substantially water-soluble component is a polymer and/or is non-cross-linkable. The tobacco material is preferably a molded portion of moist snuff tobacco. In an embodiment, the coating contains the active ingredient.

By controlling the relative amounts of the water-soluble, non-cross-linked component and the cross-linked polymer, the portion can be adapted either to break apart in the user's mouth or to remain intact in the user's mouth. In the latter case, after the soluble component dissolves in a user's mouth, the coating creates a porous network composted of a substantially insoluble polymer.

Accordingly, in an embodiment, the soluble component dissolves rapidly in a user's mouth such that the substantially insoluble cross-linked polymer component remains intact throughout use of the tobacco product, so that the coating allows the tobacco juices and flavors to leach out of the coating, while still remaining intact to hold the tobacco within the coating through the duration of tobacco use while providing a soft compliant feel to the tongue and mouth tissues. Because in this embodiment the coating acts to contain the tobacco while it is in the user's mouth, when the user desires to remove the portion from the mouth, this can be easily accomplished.

In another embodiment, the tobacco material is completely disintegrable so that once the soluble component of the coating dissolves and tobacco material has disintegrated, a user may chew and either spit out or ingest the remaining insoluble component. The coating desirably contains a minority amount of the substantially water-insoluble, cross-linked polymer, which minority amount is insufficient for the pre-portion to retain its structural integrity in the user's mouth after the water-soluble, non-cross-linked component has dissolved. Thus, the particles of tobacco contained within the coating are released and/or dispersed in the user's mouth once the water-soluble component dissolves and the pre-portioned form disintegrates.

Such portions can be prepared by forming portions of tobacco particles into units of a pre-portioned tobacco material; contacting the units of pre-portioned tobacco material with a multi-component aqueous coating solution comprising a water-soluble, non-cross-linked component and a cross-linkable polymer which forms a substantially water-insoluble polymer upon cross-linking, to form a coatings on the units of pre-portioned tobacco material; cross-linking the cross-linkable polymer to form portions of smokeless tobacco comprising the units of pre-portioned tobacco material with a semi-dissolvable coating on the surface thereof.

In a preferred embodiment, a coating is prepared from a multi-component polymer solution (coating solution). The pre-portioned amount of moist tobacco can be enclosed by the coating by applying to at least some of the outer surface of the portion a polymer solution including at least two components. At least one component of the coating solution is a water-soluble, non-cross-linkable component, which dissolves in the mouth. At least one other component in the coating solution is a water-soluble, cross-linkable polymer which becomes substantially water-insoluble after cross-linking. The coating may be applied to the moist pre-portioned tobacco by a variety of techniques, which can include dipping, spraying, and the like. The coated pre-portioned tobacco is then contacted with a cross-linking agent suitable for the cross-linkable polymer or polymers employed in the coating. This contact can result from application of the cross-linking agent to the coated portion, e.g., by spraying, dipping, or other application of a solution of cross-linking agent to the coated portion (resulting in an "outside-in" direction of cross-linking). Alternatively, cross-linking can result from contact of the cross-linkable polymer with cross-linking agent already present in the tobacco, either as the result of cross-linking agent present in the tobacco before it is formed into a pre-portion, or as the result of the application of cross-linking agent to the pre-portion prior to application of the coating.

The coating is preferably in the form of a gel, more particularly in the form of a hydrogel. As a result, a significant portion of the weight of the coating is water, in addition to the water-soluble non-cross-linked component and the substantially water-insoluble cross-linked polymer, as well as cross-linking agents, and any additives, such as preservatives, flavorants, etc. Because only the water-soluble, non-cross-linked component of the coating dissolves and releases moisture into the user's mouth, the amount of moisture released is controlled, and is not excessive. This provides the user with decreased slipperiness and improved mouthfeel when using the product.

Preferably, the water-soluble, non-cross-linked component dissolves rapidly in a user's mouth. In a preferred embodiment, the soluble component dissolves in about 0.1 seconds to about 10 seconds (e.g., about 1 second to about 9 seconds, about 2 seconds to about 8 seconds, about 3 seconds to about 7 seconds or about 4 seconds to about 6 seconds) after introduction into the oral cavity. Also preferably, the pre-portioned form loses its structural integrity within about 5 to about 15 seconds (e.g., about 6 to about 14 seconds, about 7 to about 13 seconds, about 6 to about 12 seconds, about 7 to about 11 seconds or about 8 to about 10 seconds) after introduction into the oral cavity.

The water-soluble component and substantially water-insoluble component may be natural or synthetic. Preferably the components are hydrocolloids. More preferably, the components are polysaccharides.

Optionally, the water-soluble component comprises a non-cross-linked and/or non-cross-linkable polymer. In an embodiment, the water-soluble component can be formed by a cross-linkable polymer, which has not reacted with a cross-linking agent. Suitable water-soluble non-cross-linked components include, without limitation, starch and starch derivatives, such as modified starch, dextrin, gums, such as gum arabic, guar gum, xanthan gum, locust bean gum, curdlan gum, gellan gum, fenugreek derivative gums, pullulan, chitosan, chitin, cellulose and cellulose derivatives, synthetic polymers, such as polyvinyl alcohol, polylactide, polyethylene glycol, polyvinylpyrrolidone, or polyvinylacetate, and soluble or insoluble vegetable fiber.

Suitable chemically cross-linkable polymers include, without limitation, alginate, pectin, carrageenan, and modified polysaccharides with cross-linkable functional groups. Preferred cross-linkable polymers are pectins and alginates. Proteins, for example gelatin, zein, soy protein, rice protein, and whey protein, can optionally be used to supplement or replace the cross-linkable polymers that are cross-linked with monovalent and bivalent metal ion salts. The proteins slowly cross-link with phenolics and/or aldehydes that occur naturally in tobacco.

In a preferred embodiment, the cross-linking agent is a polyvalent metal salt, more particularly, a monovalent metal ion salt or bivalent metal ion salt. While, both monovalent and bivalent metal ion salts may be used, a bivalent metal ion salt is particularly suitable for cross-linking certain polysaccharides, such as pectins. Suitable cross-linking agents include, without limitation, calcium lactate, calcium chloride, calcium lactobionate, tricalcium phosphate, calcium glycerophosphate, calcium hexametaphosphate, calcium acetate, calcium carbonate, calcium bicarbonate, calcium citrate, calcium gluconate, sodium chloride, sodium lactate, sodium acetate, sodium carbonate, sodium bicarbonate, sodium citrate, sodium gluconate, potassium chloride, potassium lactate, potassium acetate, potassium carbonate, potassium bicarbonate, potassium citrate, potassium gluconate and combinations of these.

Preferably, the pre-portioned product weighs about 1.0 to about 3.0 grams, and more preferably about 2.0 to about 2.5 grams. The weight is predominately based on the amount of tobacco used since the weight of the coating is small as compared to that of the tobacco. In an embodiment, the pre-portioned product may be up to about 1.5 inches long, up to about 1 inch in height, and up to about ¾ inch in width. Preferably, the pre-portioned product is flexible, compressible, and capable of conforming to the shape of the oral cavity.

Preferably the coating includes the active ingredient. In an embodiment, the active ingredient is included in one or more of the solutions used to make the portion.

The coating may also include a flavorant (also called a flavor additive). Suitable flavor additives for inclusion in the coating or the tobacco material include, but are not limited to, any natural or synthetic flavor or aroma, such as tobacco, smoke, menthol, peppermint, spearmint, bourbon, scotch, whiskey, cognac, hydrangea, lavender, chocolate, licorice, citrus and other fruit flavors, such as apple, peach, pear, cherry, plum, orange and grapefruit, gamma octalactone, vanillin, ethyl vanillin, breath freshener flavors, spice flavors such as cinnamon, clove, nutmeg, sage, anise, and fennel, methyl salicylate, linalool, jasmine, coffee, bergamot oil, geranium oil, lemon oil, and ginger oil. Other suitable flavors and aromas may include flavor compounds selected from the group consisting of an acid, an alcohol, an ester, and aldehyde, a ketone, a pyrazine, combinations or blends thereof and the like. Suitable flavor compounds may be selected, for example, from the group consisting of phenylacetic acid, solanone, megastimatrienone, 2-heptanone, benzylalcohol, cis-3-hexenyl acetate, valeric acid, valeric aldehyde, ester, terpene, sequiterpene, nootkatone, maltol, damascenone, pyrazine, lactone, anethole, isovaleric acid, combinations thereof and the like.

The coating may also include additives such as natural or artificial sweeteners. Preferred sweeteners include, without limitation, water soluble sweeteners, such as monosaccharides, disaccharides, and polysaccharides, such as xylose, ribose, sucrose, maltose, fructose, glucose, and mannose.

Additives such as chemesthesis agents may also be included in the coating. Suitable chemesthesis agents for inclusion in the coating include, without limitation, capsaicin, tannins, mustard oil, wintergreen oil, cinnamon oil, allicin, quinine, citric acid, and salt.

In one embodiment, the coating is created via ionic cross-linking. One or more polymers are used to create a single layer, thin coating over a portion of a tobacco material.

1. Easy-in, Loose-Out Portions

The follows relates primarily to portions that break apart in the mouth (this trait sometimes described as "easy-in, loose-out"), however aspects may apply to other types of portions.

Preferably, when preparing portions that break apart in the mouth (such a trait sometimes being termed "easy-in, loose-out"), the water-soluble non-cross-linked component is included in an amount of about 15% to about 30% by weight based on the weight of the coating solution, and the cross-linkable polymer which forms a substantially water-insoluble polymer upon cross-linking is included in an amount of about 0.3% to about 1.5% by weight based on the weight of the coating solution. Once placed in the mouth, the soluble, non-cross-linked component dissolves. The substantially insoluble, cross-linked component is insufficient to hold the particles of tobacco together, so that the tobacco is released and/or dispersed in loose form in a user's mouth. The result is a pre-portioned moist tobacco product which has sufficient structural integrity to be handled and inserted into the mouth by the user, but which breaks up after insertion in the user's mouth, to replicate the experience of using loose moist smokeless tobacco.

If less than about 15% water-soluble component is used in the coating solution, the pre-portioned product will undesirably tend to break up into large chunks upon dissolution of the water-soluble, non-cross-linked polymer. If more than about 30% of the coating solution is the water-soluble non-cross-linked polymer, the pre-portioned product will have insufficient structural integrity to allow a user to handle it while placing it in the mouth.

Preferably, the substantially water-insoluble component is formed by reacting a chemically cross-linkable polymer with a cross-linking agent. Preferably, the coating solution includes the substantially water-insoluble component in an amount of about 0.3% to about 1.5% by weight based on the weight of the coating solution. If less than about 0.3% substantially water-insoluble component is used in the coating solution, the pre-portioned product will be too weak for a user to handle when placing in the mouth, and will break apart. If a coating contains more than about 1.5% substantially water insoluble component, the coating will provide greater structural integrity to the product, so that it will tend not to break apart and disperse the tobacco material in the user's mouth, which is not desired in this embodiment.

The amount of cross-linking agent used will depend to a large extent on the amount of cross-linkable polymer included in the coating mixture. For the preferred amounts of cross-linkable polymers disclosed herein, preferably, the cross-linking agent is included in a cross-linking solution of about 0.5 wt % to about 2.0 wt %, based on the total weight of the cross-linking solution, more preferably about 0.5 wt % to about 1.5 wt %. Using less than about 0.5 wt % cross-linking agent will generally not provide enough cross-linking agent to react with the amounts of cross-linkable polymer included in the coating mixture, which tends to result in a weak coating that will not provide the pre-portioned product with sufficient structural integrity for user handling when retrieving the product and positioning it in the oral cavity. Using more than about 2.0 wt % is unnecessary due to the low amount of cross-linkable polymer present, thereby adding unnecessary cost to the product, and may adversely affect the flavor of the product.

Once the water-soluble component of the coating dissolves, flavors and water are released into the user's mouth and the pre-portioned product loses its structural integrity so that the tobacco enclosed by the coating is released. The pre-portioned product thus provides both rapid flavor release and a replication of the experience of using loose moist smokeless tobacco very soon after insertion into the user's oral cavity.

In addition, due to the presence of relatively small amounts of water-soluble component, excess water and juice are not released upon disintegration of the pre-portioned product. The combination of polymers in the coating, in the ranges disclosed herein, provides a soft compliant feel to the tongue and mouth tissues, and dissolves quickly, so that the sensory experience associated with moist tobacco use is rapid and unencumbered. In addition, because only small quantities of the substantially water-insoluble cross-linked polymer remain on a small quantity of the tobacco (i.e., only that quantity of tobacco that was actually in contact with the coating) after the pre-portioned product has disintegrated in the user's mouth, the tobacco that disperses is essentially uncoated. The resulting sensory experience replicates more closely what users expect from moist smokeless tobacco than would a product where the individual particles have been coated.

In a preferred embodiment, the coating is not messy or sticky to the touch. With the at least two polymers are used to create the coating, when a user touches the coating, the polymers do not disassociate from one another. Therefore, the coating is not sticky when the product is removed from a package and placed in the mouth.

2. Easy-in, Easy-Out Portions

The follows relates primarily to portions adapted to remain intact in the mouth of a user (a trait sometimes described as "easy-in, easy-out"), however aspects may apply to other types of portions.

In a preferred embodiment, a multi-component polymer coating containing at least two polymers is used so that the properties of the coating, such as the rate of dissolution and the size and amount of pores in the coating, can be controlled. Such a coating comprising two polymers is sometimes referred to as a "super-hydrated membrane coating."

Preferably, the coating is aesthetically pleasing, non-tacky, and pleasant to touch, while being strong enough to maintain the integrity of the portion of moist tobacco material contained inside the coating during insertion and placement in the mouth. The coating is preferably clear, but fillers may be added to provide the coating with a desired color or appearance.

The coating described below has advantages over other coatings. These advantages are described in commonly-owned U.S. Patent Publication No. 2008/0202533.

The super-hydrated membrane coating preferably creates a porous network of an insoluble polymer after the soluble component dissolves in a user's mouth. Preferably, the first component is a soluble component that dissolves rapidly in a user's mouth such that the second component, which is preferably the insoluble component, remains intact throughout use of the tobacco product.

Preferably, the soluble component is formed by a non-cross-linkable polymer. As used herein, the term "non-cross-linkable" denotes that the material does not become cross-linked to a significant extent when subjected to conditions that cross-link the insoluble component. Also preferably, the insoluble component is formed by a chemically, cross-linkable polymer reacted with a cross-linking agent. The polymers of the soluble component and insoluble component may be natural or synthetic. Preferably the polymers are hydrocolloids. More preferably, the polymers are polysaccharides.

In a preferred embodiment, the cross-linking agent is a monovalent metal ion salt or bivalent metal ion salt.

Suitable non-chemically-cross-linkable polymers include, without limitation, starch, dextrin, gum arabic, guar gum, chitosan, cellulose, polyvinyl alcohol, polylactide, gelatin, soy protein, and whey protein.

Suitable chemically, cross-linkable polymers include, without limitation, alginate, pectin, carrageenan, and modified polysaccharides with crosslinkable functional groups. The preferred cross-linkable polymer is alginate.

While, both monovalent and bivalent metal ion salts may be used, preferably a bivalent metal ion salt is used. Suitable bivalent metal ion salts include, without limitation, calcium lactate and calcium chloride. Calcium lactate is preferred since it is approved for use in food products.

Once the soluble component of the coating dissolves, pores are created in a polymer network through which the tobacco juices and flavors flow. Flavors and water are released into the user's mouth as the soluble component of the coating dissolves. The tobacco flavors and juices are then released through the pores so that the flavor experience is seamless from beginning to end. In a preferred embodiment, the bulk density of the coated tobacco product is about $1.0 \pm 0.2$ g/cm$^3$.

Preferably, the pores, created when the soluble component of the coating dissolves, are large enough to allow the unencumbered flow of juices, while remaining small enough to prevent shreds or particles of tobacco from traveling through the pores and into the user's mouth.

The coating preferably encloses a pre-portioned tobacco material. Also, the coating allows the tobacco juices and flavors to leach out of the coating, while still remaining intact to hold the tobacco within the coating through the duration of tobacco use. The coating provides a soft compliant feel to the tongue and mouth tissues.

Because the soluble component of the coating dissolves quickly, the sensory experience associated with moist tobacco use is rapid and unencumbered.

Once the soluble component of the super-hydrated membrane coating dissolves or disintegrates, additional moisture and/or flavors are released into the use's mouth. Thereafter, the flavors and tobacco juices pass through the coating to provide an uninterrupted flavor experience to the user.

In a preferred embodiment, the super-hydrated membrane coating may be provided with a desired rate of dissolution of the soluble component of the coating by altering the proportion of the soluble component to the insoluble component.

In a preferred embodiment, the super-hydrated membrane coating is not messy or sticky to the touch. Because at least two polymers are used to create the coating, when a user touches the coating, the polymers do not disassociate from one another. Therefore, the coating is not sticky when the product is removed from a package and placed in the mouth.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the life. Genetically modified tobacco may also be used.

Additionally, the tobacco material may also include a supplemental amount of vegetable or plant fibers or particles, such as particles of shreds of lettuce, cotton, flax, beet fiber, cellulosic fibers, blends thereof and the like.

In one embodiment, the super-hydrated membrane coating is created via ionic cross-linking. One or more polymers are used to create a single layer, thin membrane coating over a portion of a tobacco material.

In a preferred embodiment, a multi-component polymer coating containing at least two polymers is used so that the properties of the super-hydrated membrane coating, such as the rate of dissolution and the size and amount of pores in the coating, can be controlled.

The size of the pores, created when the soluble component dissolves, may be altered by patterning the coating in such a way as to ensure the soluble component is only in certain spots and in certain amounts so that once the soluble component dissolves away the pores are of a desired size.

In an embodiment, tobacco material is dipped in a polymer solution containing two different polymers dissolved in water. Preferably, a chemically cross-linkable polymer and a non-cross-linkable polymer are used.

Because moist tobacco naturally contains salts such as calcium ions, the calcium ions preferably cross-link with the cross-linkable polymer to form a skin or shell on the inside of the coating once the tobacco material has been contacted with the two polymer solution. Later, when the coating is exposed to a cross-linking agent, an outer skin or shell can form on the coating. The inner and outer skins or shells provide a moisture barrier for the tobacco and the soluble portion of the coating. Preferably, the shells/skins are formed of a discontinuous, cross-linkable polymer with regions of the non-cross-linkable polymer incorporated therein.

In a preferred embodiment, the concentration of the film forming polymer solution is about 0.5 wt % to about 20 wt % polymer in the solution. Most preferably, the concentration of the film forming polymer solution is about 1 wt % to about 1.5 wt % of the polymer components, with the balance being water.

The concentration of the polymer solution determines the thickness of the coating membrane. The thickness of the coating can in turn affect how quickly the soluble component of the coating dissolves in a user's mouth. The coating is a moist, gel-like coating when formed and the moistness is preferably retained until use. Preferably, the coated tobacco product is hermetically sealed in suitable packaging to prevent moisture in the tobacco and coating from evaporating.

If the coating is peeled off of the tobacco product and completely dried, the coating is preferably about 0.02 mm to 1.0 mm thick. More preferably, when the coating is completely dried, it is about 0.08 mm to 0.14 mm thick. In a most preferred embodiment, the coating when completely dried is about 0.11 mm thick. It should be noted that the coating is not intended to be dried, but rather retains a high moisture content.

In a preferred embodiment, the weight of the coating when completely dried is about 0.013 g for a coated tobacco product weighing about 2.5 g. In contrast, the weight of the coating for a coated tobacco product weighing about 2.5 g, when the coating is at the preferred moisture content is about 0.15 g.

After coating the tobacco material with the film forming polymer solution, cross-linking is conducted with a cross-linking solution including a monovalent metal ion salt or a bivalent metal ion salt.

Preferably, the cross-linking solution contains a bivalent metal ion salt. Most preferably, the cross-linking solution includes calcium lactate, which is commonly used in the food industry. In one embodiment, the cross-linking solution is a 2.0 wt % calcium lactate solution.

The tobacco product is then exposed to air or patted dry to evaporate excess moisture. The tobacco product is not dried extensively, so that the super-hydrated coating retains a high moisture content.

By using both a non-cross-linkable polymer and a cross-linkable polymer, the porosity and strength of the super-hydrated membrane coating can be controlled. For instance, the dissolution rate of the resulting super-hydrated membrane coating can be altered by modifying the specific proportion of cross-linked to non-cross-linked polymers. In a preferred embodiment, the coating contains about 10 wt % to about 90 wt % of the cross-linked polymer. Preferably, the proportion of cross-linked polymer in the coating is about 60 wt % to about 70 wt %.

In another embodiment, the polymer solution and the cross-linking solution can be patterned, overprinted, or sprayed onto the tobacco material preform to form a network having a soluble component and an insoluble component. The polymer solution may include a chemically, cross-linkable polymer and a non-cross-linkable polymer. Alternatively, the polymer solution may include a single chemically, cross-linkable polymer. When a single polymer is used, the cross-linking solution may be selectively sprayed to leave some portions of the coating non-cross-linked and soluble. The soluble component of the coating may dissolve, leaving a porous network of insoluble component in place to maintain coherence of the tobacco material, while allowing the free flow of saliva in the user's mouth.

In an embodiment, the process may be automated. For instance, the coating step may occur via spraying the polymer solution and the cross-linking solution alternately onto a preformed portion of tobacco material to create a cross-linked, thin, super-hydrated membrane coating of a desired thickness.

In an embodiment, tobacco-based polymers may be substituted for non-tobacco sourced materials in the coating. Flavorful tobacco compounds may be extracted from the tobacco based material in order to modify the tobacco flavor character to initial in-mouth experience. However, such high extraction is unnecessary.

In one embodiment, additional dissolvable tobacco such as tobacco extracts or colloidal encapsulated tobacco can be added to the coating to increase the initial tobacco flavor in the first stages of the dissolution of the super-hydrated membrane coating. Fillers may be added to the coating to make the coating opaque. Colorants may also be added to alter the color of the coating.

While the foregoing has been described in detail with reference to specific embodiments thereof, it will be apparent to one skilled in the art that various changes and modifications may be made, and equivalents thereof employed, without departing from the scope of the claims.

What is claimed is:

1. An oral product comprising:

a pouch including, a porous wrapper, and an active ingredient on the porous wrapper, the active ingredient including camphor in an amount ranging from 2 nanograms to 400 nanograms 4; and a filling inside the pouch, the filling including tobacco, an overall weight of the oral product ranging from 0.2 to 5 g.

2. The oral product of claim 1, further comprising:

a dissolvable coating on the porous wrapper, the dissolvable coating including the active ingredient.

3. The oral product of claim 2, wherein the dissolvable coating is on an inside of the porous wrapper.

4. The oral product of claim 2, wherein the dissolvable coating is on an outside of the porous wrapper.

5. The oral product of claim 2, wherein the dissolvable coating is on an inside of the porous wrapper and an outside of the porous wrapper.

6. The oral product of claim 1, wherein the active ingredient is encapsulated.

7. The oral product of claim 1, wherein the camphor is encapsulated in cyclodextrin.

8. The oral product of claim 1, wherein the camphor is present in an amount ranging from 2 nanograms to 20 nanograms.

9. The oral product of claim 8, wherein the camphor is present in an amount ranging from 10 nanograms to 15 nanograms.

10. The oral product of claim 1, wherein the pouch includes, the porous wrapper defining an interior region and having a free end, the filling in the interior region, and a seam enclosing the interior region and offset from the free end, the free end being unbonded.

11. The oral product of claim 1, wherein the filling further includes a flavorant.

12. The oral product of claim 1, wherein the filling further includes a sweetener.

13. The oral product of claim 1, wherein the filling further includes a humectant.

14. The oral product of claim 1, wherein the pouch has a generally rectangular shape.

15. The oral product of claim 1, wherein the pouch has a generally elliptical shape.

16. The oral product of claim 1, wherein the pouch has a first dimension ranging from 20 mm to 35 mm, the pouch has a second dimension ranging from 10 mm to 20 mm, and the pouch has a third dimension ranging from 3 mm to 6 mm.

17. The oral product of claim 1, wherein the active ingredient further includes a mercaptan, borneol, isoborneol, bornyl acetate, isobornyl acetate, mono-bornyl succinate, mono-isobornyl succinate, mono-bornyl formate, mono-isobornyl formate, or any combination thereof.

18. The oral product of claim 17, wherein the active ingredient further includes the mercaptan, and the mercaptan is a furfuryl mercaptan, a benzyl mercaptan, a methyl mercaptan, a propyl mercaptan, or any combination thereof.

19. The oral product of claim 1, wherein the tobacco is in the form of shreds, particles, or both shreds and particles.

20. The oral product of claim 2, wherein the camphor is configured to reduce or prevent sensory irritation.

* * * * *